US010130531B1

(12) United States Patent
Laconis

(10) Patent No.: US 10,130,531 B1
(45) Date of Patent: Nov. 20, 2018

(54) APPARATUS FOR CONSTRUCTING VARIABLE CONFIGURATIONS OF AN ATTACHABLE/DETACHABLE MOTORIZED DRIVE FOR STANDARD WHEELCHAIRS

(71) Applicant: Gregory Edward Laconis, Houston, TX (US)

(72) Inventor: Gregory Edward Laconis, Houston, TX (US)

( * ) Notice: Subject to any disclaimer, the term of this patent is extended or adjusted under 35 U.S.C. 154(b) by 0 days.

(21) Appl. No.: 14/634,930

(22) Filed: Mar. 2, 2015

(51) Int. Cl.
*A61G 5/04* (2013.01)
*A61G 5/10* (2006.01)

(52) U.S. Cl.
CPC ..... *A61G 5/042* (2013.01); *A61G 5/10* (2013.01); *A61G 2005/1051* (2013.01)

(58) Field of Classification Search
CPC ... A61G 5/042; A61G 5/10; A61G 2005/1051
USPC ..... 180/12
See application file for complete search history.

(56) References Cited

U.S. PATENT DOCUMENTS 5,651,422 A * 7/1997 Casali ..... A61G 5/047 180/13
7,216,728 B2 * 5/2007 Huang ..... A61G 5/047 180/13
8,065,051 B2 * 11/2011 Chopcinski ..... A61G 5/04 701/1
2010/0300777 A1 * 12/2010 Tallino ..... A61G 5/047 180/12

* cited by examiner

*Primary Examiner* — Kevin Hurley
*Assistant Examiner* — Felicia L. Brittman

(57) ABSTRACT

A set of devices with multiple combinations, any one of which said combination may be affixed to a manual wheelchair thereupon providing electrically driven motive source to propel and control the wheelchair. The options include choice of: either an internally driven wheel driver hub or a driver hub powered by an external motor; either disc brakes or regenerative braking using the internal drive electric driver hub; any one of four different control column configurations, left mount, right mount, center mount or mounting on both sides of the wheelchair, single wheel or double wheel drive; and controls comprising an LCD monitor, brake handle and thumb throttle mountable on either one or both of the handle bars of the chosen control columns.

11 Claims, 40 Drawing Sheets

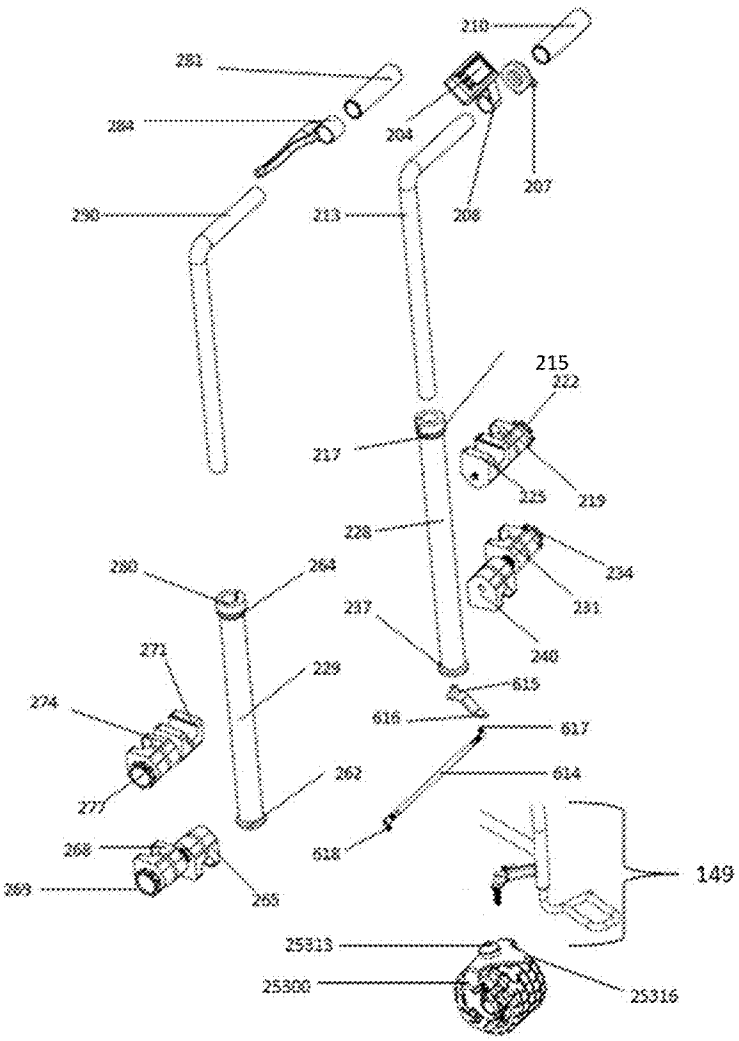
149
25316
25313
25306
215
213
217
218
219
220
221
222
223
224
225
226
227
228
229
230
231
232
233
234
235
236
237
238
239
240
241
242
243
244
245
246
247
248
249
250
251
252
253
254
255
256

APPARATUS FOR CONSTRUCTING VARIABLE CONFIGURATIONS OF AN ATTACHABLE/DETACHABLE MOTORIZED DRIVE FOR STANDARD WHEELCHAIRS

BACKGROUND OF THE INVENTION AND PRIOR ART

This invention relates generally to attachment of a powered drive means to standard wheelchairs and specifically to wheelchairs that are manually operable, non-foldable or foldable and readily transportable.

Manually operable, i.e., hand propelled, wheelchairs have been manufactured for more than a century without significant change. Generally hand rings are mounted on large drive wheels to assist in propulsion by the user, although very often the actual tires are gripped by the user to propel the wheelchair. Such wheelchairs are generally satisfactory for indoor use over fairly short distances where floors are usually flat and smooth where the operator has sufficient upper body strength in at least one arm to propel the wheelchair. Operating on sloped or rough surfaces entails challenges for the person sitting in the chair. Persons with a more limited range of motion require additional provisions for driving and steering the chair. Particularly for persons paralyzed from the neck down, the problem of operating a motorized wheelchair has been great.

Various methods, generally described as human interface devices, have been proposed for allowing disabled persons, including quadriplegics, to control a motorized wheelchair. For example, breath-controlled wheelchair systems have been proposed in which a disabled person controls the chair by sucking or blowing into one or more tubes; e.g., the sip and puff system. The degree of control which can be provided is limited by the number of tubes used. Joy stick controls have been popular where direction and speed are provided by the position of a universal motion joy-stick. In the case of the disclosed apparatus, left or right joy-stick movement, for example, would control steering the wheel driver hub or hubs. Forward or back joy-stick movement would control the speed of the wheel driver hub or hubs in the forward or backward rotation.

Voice-controlled wheelchairs have also been proposed, but the variety and precision of the control they afforded has been less desirable. Furthermore, there has been a problem with commands being heard by the control system and the potential for the control system responding to a false command picked up from ambient noise, such as from the voices of people around the wheelchair.

There are other methods for controlling wheelchair movement. These are well documented in the art. Those skilled in the art will be familiar with modular or integral control systems and, in addition to those systems discussed above, will have knowledge of controls using movements of the chin, head, finger, touch pads, wafer boards, proximity switches as well as remote radio controls and/or voice commands including interfaces with mobile devices or timers controlling usage.

Outdoor operation on soft ground and up and down grades, presents additional, challenging obstacles for both users of a hand propelled wheelchair and for those users unable to provide hand propulsion who depend on powered wheelchairs with electrical controls such as joy-stick controllers.

Most powered wheelchairs and powered scooters are heavy, complicated, expensive machines. They have small, fat tires and fairly complex joy stick-operated control systems. They generally include two electric motors that may be driven by one or more large lead-acid batteries. While intended for outdoor as well as indoor use, the machines are ill-suited for unpaved surfaces like grass and dirt. Nonetheless, powered wheelchairs and scooters have been a boon to the handicapped and elderly.

Scooters generally have a single motor that drives the wheels through a differential. While the costs and weight of a differential are about the same as an extra motor and gear reduction mechanism, the controls on the scooter are less complicated and the unit is generally more reliable than a two-motor wheelchair. Steering of the front wheel of the scooter is accomplished with a small handlebar. The shopping cart is the most popular type powered scooter and, while designed primarily for indoor use, it also sees limited outdoor service in transporting both the user and groceries across a store parking lot. These vehicles' major drawbacks of cost, bulk and weight (generally in the range of 150 to 200 pounds), have prevented their widespread acceptance despite their obvious advantages. In contrast, each of the variations of the disclosed apparatus weighs approximately twenty-five pounds. Conventional powered chairs or scooters also require special measures in order to transport them. A serious drawback is that the motor drives the wheels through gearing which cannot be overdriven. Thus, a drive failure, or a dead battery, can leave the 200 pound vehicle frozen in place with its wheels effectively locked and the user helplessly stranded.

Generally, a special type van, or other vehicle providing a large door opening and specialized access equipment, is required to transport powered wheelchairs and powered scooters. The expensive vehicle is usually equipped with a power lift of some sort to enable loading and unloading of such a wheelchair.

The present invention is specifically directed to standard, manual wheelchairs. Despite the maneuverability and transportability of these manual wheelchairs, powered wheelchairs are far more capable of handling grades, soft surfaces such as grass and off road conditions. There are other devices for converting manual wheelchairs to power, but none using the single or double powered wheel/s of the present invention. The present invention set fulfills the need to enable light weight wheelchairs to be less expensively motorized and, if necessary, provide the option for joy-stick, head movement, voice control or other similar human interface devices for control without detracting from the appearance, maneuverability and transportability of the wheelchair.

The optional configurations of the disclosed invention may be both attached to a standard wheelchair and detached if desired. When detached, the disclosed apparatus is readily transportable in the trunk of a compact or larger automobile with the chair. The disclosed apparatus including the electric battery providing motive power may be attached to a standard chair in a few minutes. When attached, the powered driver hub or hubs move in parallel with the front caster wheels of the wheelchair. In the preferred embodiment of the disclosed invention, the drive mechanism consists of a wheel driver hub or hubs revealed in the U.S. Pat. No. 6,974,399 entitled, "Hub motor mechanism" and issued to Chiu-Hsiang Lo or similar apparatus. This patent describes an electrically driven hub or hubs comprising an electrical motor or motors each with a planetary gear system connected to the motor/s. Such driver hubs have the facility for regenerative braking which may be controlled by the wheelchair user employing features which may be included in one of the combinations of the disclosed set of devices. Additionally, disc brakes working in combination with regenerative braking are included the choices for configuration. A first fixed column is connected to the stator of a single electrical motor and a second fixed column is connected to a second end of the stator of a second electrical motor if the double drive is selected. Both first and/or second fixed columns are connected to the vehicle frame. A one-way clutch is connected between a cover of the driver hub/s and the planetary gear system so that the hub/s is/are rotated when the planetary gear system is activated by the motor/s powered by a battery. The rotatable castor wheels at the front of the wheelchair follow the movement of the hub/s. When the battery power is disconnected from the hub/s, the hub/s is/are free to rotate to follow the motion of the castor wheels when the wheelchair is operated in the manual mode. In an alternative embodiment to manual steering, the hub or hubs of the disclosed invention may be steered using an external motor and chain drive. This feature would enable steering by a disabled user unable to steer by hand. Either or both caster wheels may be removed from their supportive caster arms to accommodate implementation of a selected configuration of the disclosed apparatus.

The wheelchair may be operated in the manual mode even when the apparatus is attached. In this state, the wheelchair may still be easily hand propelled because of the disclosed invention's light weight and lack of bulk. When the wheel driver hub/s of the disclosed invention is/are engaged, the propelled wheelchair has excellent maneuverability and speeds greater than what can be achieved manually. Steering is accomplished in the preferred embodiment by turning the propelling wheel driver hub/s and is controlled by the user using a handlebar, or, alternatively using another means of control such as a joy-stick or other human interface device operating through servo-mechanisms. Such servo-mechanisms may include a motor drive for controlling steering. The turning radius of the wheelchair with the disclosed invention attached is approximately the same as the chair with the apparatus detached. As stated, additional controls for speed and steering may be added for those users who are unable to operate the handlebars and speed controls manually.

OBJECTS OF THE INVENTION

A principal object of the invention is to provide an affordable attachment for a standard wheelchair where said attachment provides electrically powered propulsion.

Another object of the invention is to provide a novel propulsion system for powering a standard wheelchair that is easily attached to and detached from the wheelchair or may be permanently mounted.

Another object of the invention is to provide a novel propulsion system that is lightweight, and easily transportable.

A feature of the invention resides in the arrangement for rapidly converting a manual wheelchair into a powered wheelchair employing a selected combination of a steering means, propulsion means, control means, function monitoring means, and braking means.

Another feature of the invention resides in a motorized and steerable wheel driver hub or hubs that provide/s forward or reverse propulsion with steering accomplished with an attached handlebar, or less manual application such as a joy-stick, voice control or other non-manual means. The wheel driver hubs may be either an electrical hub with internal motor or a hub driven by an external motor.

A still further feature of the invention resides in adjustable clamping means for enabling the invention to be attached to wheel chairs with a range of dimensions and differing frame structures.

Another feature of the invention resides in the capability for powering the wheelchair with front wheel drive provided by one or two powered wheel drivers.

Yet another feature of the disclosed invention provides choice of steering column placement on the left, right or center of the front of the wheelchair with two telescoping adjustments of the steering column apparatus in the center position whereby different sections of the steering column may be secured at different lengths to ergonomically accommodate the user and to fit a particular wheelchair's dimensions.

An additional feature of the disclosed invention provides for alternative placement on the steering column or optional additional column on the opposite side of the wheelchair of the throttle, handbrake and or the LCD panel monitoring functions. If a two driver hub combination is chosen, the columns are interconnected so that the rotation of the columns and that attached hubs are co-moving. If a single driver hub is chosen with a left and right column, the two columns are not inter-connected so as to be co-moving. The castor wheel on the side of the column without the driver hub will follow any steering maneuver of the rotated driver hub. The column without the driver hub is used for support of the user. The controls and monitor can be mounted on either or both columns interchangeably.

Yet another feature of the disclosed invention is that the top section of a chosen center steering column may be unlocked and rotated toward or away from the user facilitating access to or egress from the wheelchair.

A further object of the disclosed invention is to provide the capability of modifying the preferred embodiment of the disclosed apparatus to provide the capability for controlling the powered movement by using any of the variety of human interface devices such as a joystick, directional control knob, sip and puff system, computer mediated voice control or others.

BRIEF DESCRIPTION OF THE DRAWINGS

These and other objects and features of the invention will be apparent upon reading the following description in conjunction with the drawings in which:

FIG. 3A additionally shows a first and second driver hub mounted on the right and left of the wheelchair using the front caster mounts formerly supporting the caster wheels and the control linkage with the steering column controlling the direction of the hubs and the linking control cables. This configuration, as with others disclosed, may be made permanently attached to the wheel chair and is a separate and distinct improvement over the apparatus described in U.S. Pat. No. 8,684,113, "Attachable, powered drive apparatus for wheelchairs."

In FIG. 6A, the LCD assembly and thumb throttle are mounted on the left handlebar and the brake handle is mounted on the right handlebar.

FIG. 6H is an exploded view of the column parts of configuration shown in FIGS. 6C and 6G and with the electrical and brake cables that are attached as shown in FIG. 6C.

SUMMARY OF THE INVENTION

The disclosed invention comprises a set of devices from which a configuration may be chosen which may be easily attached and detached from a standard wheelchair. The chosen configuration features a powered wheel or wheels which may be directed forward or reversed, steered and monitored by the wheelchair occupant. The devices may be permanently attached as well. Thus, the chosen configuration converts a manually operable wheelchair into a motor driven wheelchair. The components include steering mechanisms comprising steering and support columns that may be clamped in place to frames on either side of the wheelchair or in the center in front of the seat, in one configuration, a clamping crossbar that may be attached to the frame of the wheelchair to enable placement of a center steering column, a battery and battery holder, an LCD monitor assembly showing battery life, speed, time of day, and braking and with a switch controlling forward and reverse directions, two different types of motorized driver hubs, cables to connect the controls and battery to power the driver hubs and a braking system. The lengths of the steering and support columns may be adjusted. The top portion of the center steering column may also be rotated forward to facilitate getting into the wheelchair and rotated back into position for driving. The crossbar of the center steering configuration of the disclosed apparatus is adjustable to adapt to a range of wheelchair strut configurations. In every configuration or steering columns, support columns or center steering column, the front caster wheels of the wheelchair co-move with the driver hub or hubs when said hubs are rotated by the wheelchair occupant.

An alternative choice of steering and support columns comprising steering and control means at the top of the steering column and culminating in a motor driven wheel at the bottom of said steering column is similarly available. A steering column with a driver hub may be attached perpendicularly to either side of the wheelchair. A support column may be mounted on the opposite side of the wheelchair from the steering column. These configurations may include driver hubs on one or both sides of the wheelchair. A single steering column may be mounted in the center of the wheelchair and attached to a crossbar clamped to horizontal members of the wheelchair and with a fitting that permits the center steering column to rotate between a position where it is vertical or rotated forward. The disclosed apparatus has another feature wherein an upper portion of the centrally placed steering column may be folded forward to enable easier access by the user of the wheelchair.

DETAILED DESCRIPTION OF PREFERRED EMBODIMENTS

Figure 1A:
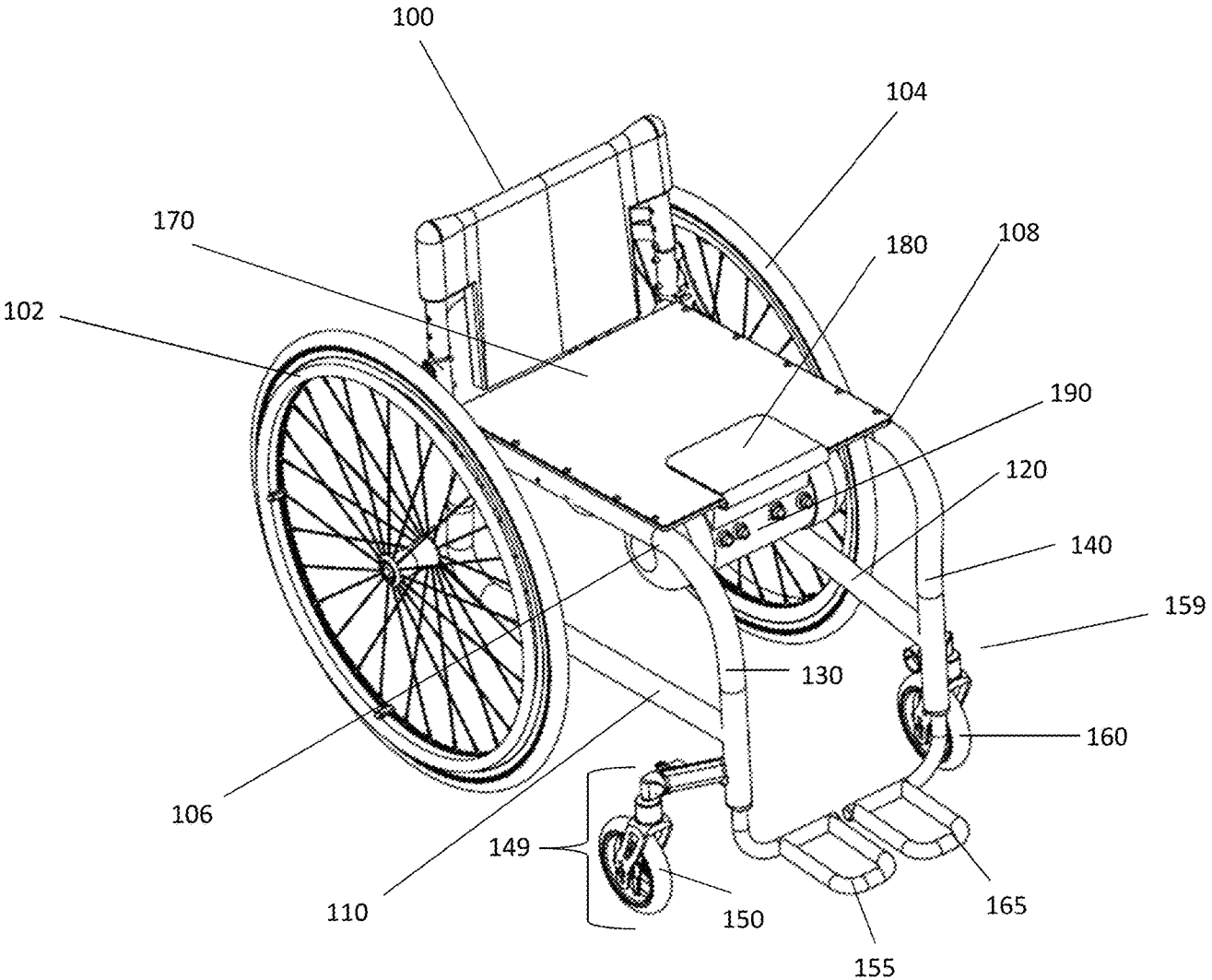
FIG. 1A shows a prior art, manually operable wheelchair 100 with numbered customary features.

FIG. 1A shows a prior art, manually operated wheelchair 100 with propulsive wheels 102 and 104, and with typical upper lateral frame members 106 and 108, with lower lateral horizontal frame members 110 and 120, vertical lateral frame members 130 and 140, right front caster wheel 150 attached to right front caster arm 149 and left front caster wheel 160 attached to left front caster arm 159, front foot rests 155 and 165 and seat 170. This figure also shown a battery assembly 178 with battery holder 180 attached to the seat and containing a battery 190. The battery assembly is further shown in FIGS. 1B and 1C. The battery holder and battery are not part of the typical manually operated wheelchair but are part of the disclosed apparatus which will be shown in subsequent figures. Some of these wheelchairs are designed for portability, and generally include mechanisms that permit folding to facilitate storage in automobile trunks and the like. It will be appreciated that such wheelchairs are well known in the art and form no part of the present invention. The features and capabilities of the combination of elements to provide motive power to the standard wheelchair will be revealed in the following discussion.

Figure 1B:
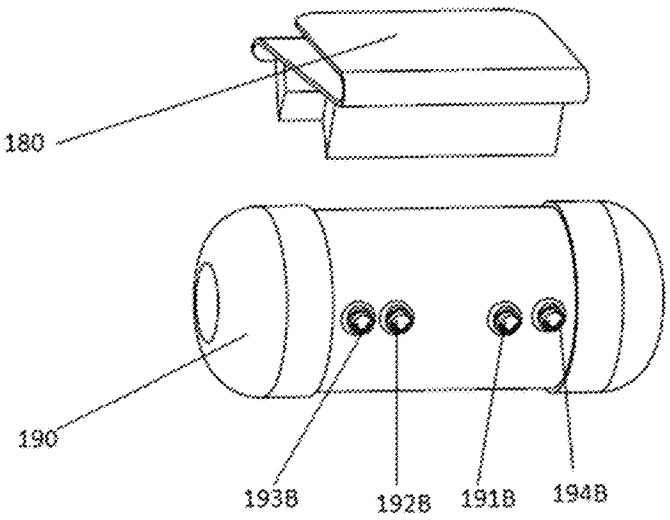
FIG. 1B shows a battery holder 180 which may be affixed to the seat of the wheelchair 170 and an electric battery 190 used to provide power to the controls and motive wheels.

FIG. 1B shows the battery holder 180 and the separate battery 190 with first, second, third and fourth battery insert ports 191B, 192B, 193B and 194B. Battery insert port 191B will receive the electric brake connector 191, battery insert port 192B will receive the LCD 204, Thumb Throttle and Forward/Reverse switch 207 connector 192, battery insert port 193B will receive the driver hub motor connector193 and battery insert port 194B will receive a dual hub driver motor connector 194. The cable connections will be additionally described in FIGS. 7B and 7C.

Figure 1C:
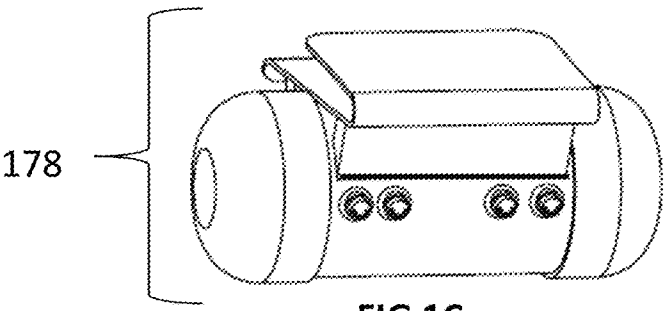
FIG. 1C shows the assembly 178 of the battery mounted in the battery holder.

FIG. 1C shows the battery 190 inserted into the battery holder 180.

Figure 2A:
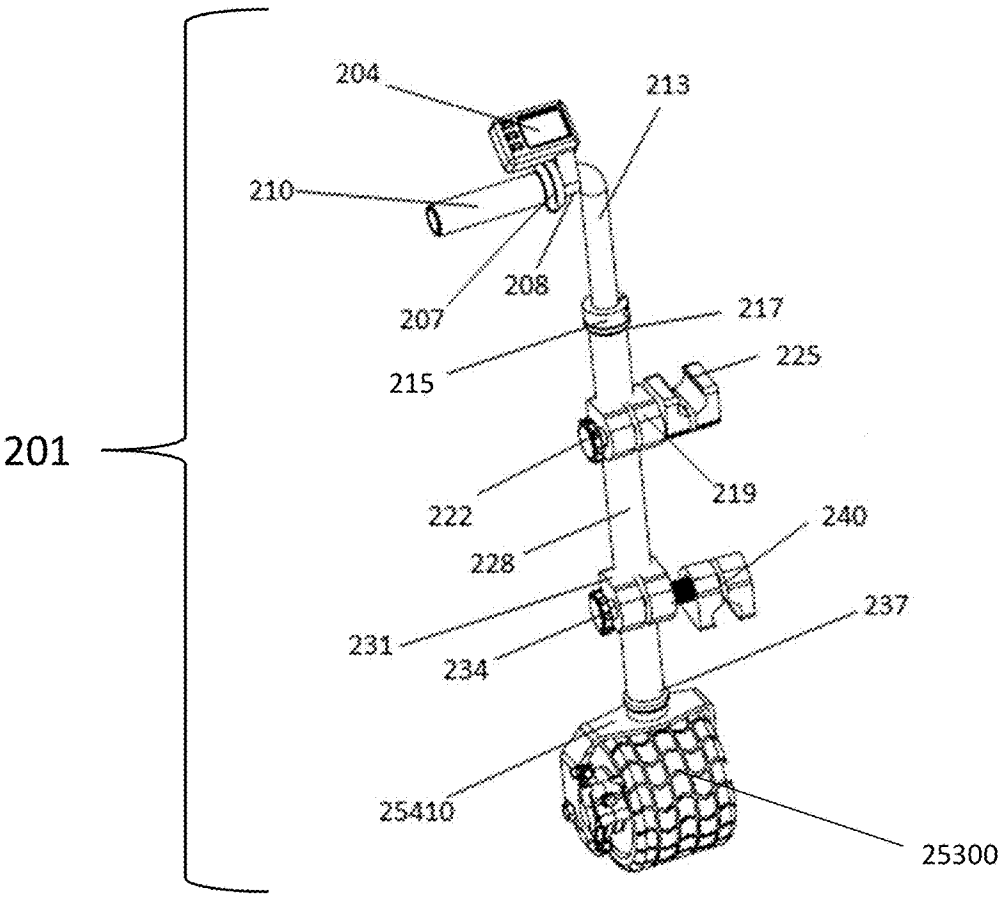
FIG. 2A shows a direct drive steering column 201 which may be mounted on either side of the wheelchair. A driver hub assembly 25300 using a 25410 fork where said assembly is attached to the bottom of said steering column. Additional numbered elements of said steering column include a LCD monitor assembly 204 wherein said assembly includes a forward/reverse switch 208 and thumb throttle 207 mounted on the handlebar portion 210 of said steering column. The caster wheel on the side of the driver hub assembly is removed. Alternatively, the driver hub assembly 25300 could be replaced by a driver hub powered by an external motor 25400.

FIG. 2A shows an isolated view of a direct drive steering column 201 to be attached to one side of a wheelchair 100 and with a driver hub assembly attached 25300. The LCD monitoring assembly 204 with built in forward/reverse switch 208 and the thumb throttle 207 are mounted on the handlebar portion of the steering piece 213. The hand grip 210 is then slid onto the handlebar portion of the steer tube 213. Attaching the steering column 201 shown in FIG. 2A to the wheelchair 100 is accomplished by removing the caster wheel on the side of the chair where the steering column 201 is to be attached, then, affixing clamp 225 onto the right upper horizontal strut 106 of the wheelchair 100. Clamp 225 is tightened using knob 222. Clamp 240 is then affixed to the right lower horizontal strut 110 of the wheelchair 100. This clamp is tightened using knob 234. Additional numbered features of said direct drive steering column 201 and driver hub assembly 25300 will be explained and detailed in subsequent drawings. The column 201 may be permanently attached to said wheelchair if desired.

Figure 2B:
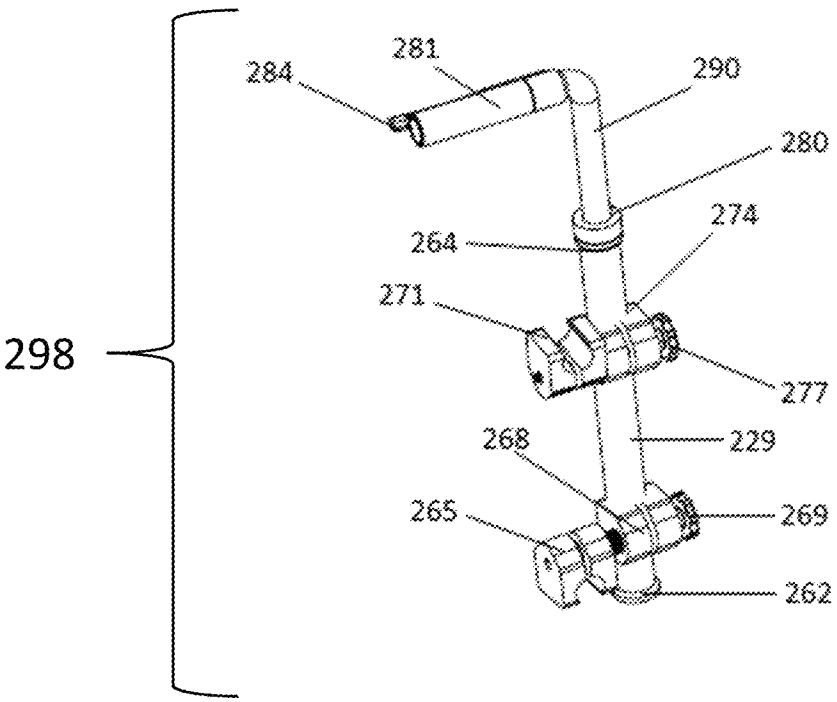
FIG. 2B shows a support column 298 which may be mounted on the opposite side of the wheelchair from a mounted steering column 201. A brake handle 284 may be mounted on the handlebar portion 281 of said support column. The braking system is further described in FIG. 2E. The steering column 201 may be placed on either side of the wheelchair 100. The support column 298 would then be place on the opposite side of the wheelchair 100.

FIG. 2B shows a support column 298 which may be attached to the wheelchair 100 on the opposite side from the steering column 201. In a similar manner, attaching the support column 298 to the wheelchair 100 is accomplished by affixing clamp 271 to the left, upper horizontal strut 108 and tightening said clamp using knob 277. Next, clamp 265 is affixed to the left lower horizontal strut 120. Clamp 265 is tightened using knob 277. The brake handle 284 is mounted on the brake handle portion of piece 290 and the support tube hand grip 281 is then slid on. As described in FIG. 2E, the brake handle controls a brake system comprising two elements: a first element comprising a disc brake producing stopping power by frictional compression and a second component comprising regenerative induction braking using reversal of the electrical motor. Additional features of support column 298 will be explained in subsequent drawings.

Figure 2C:
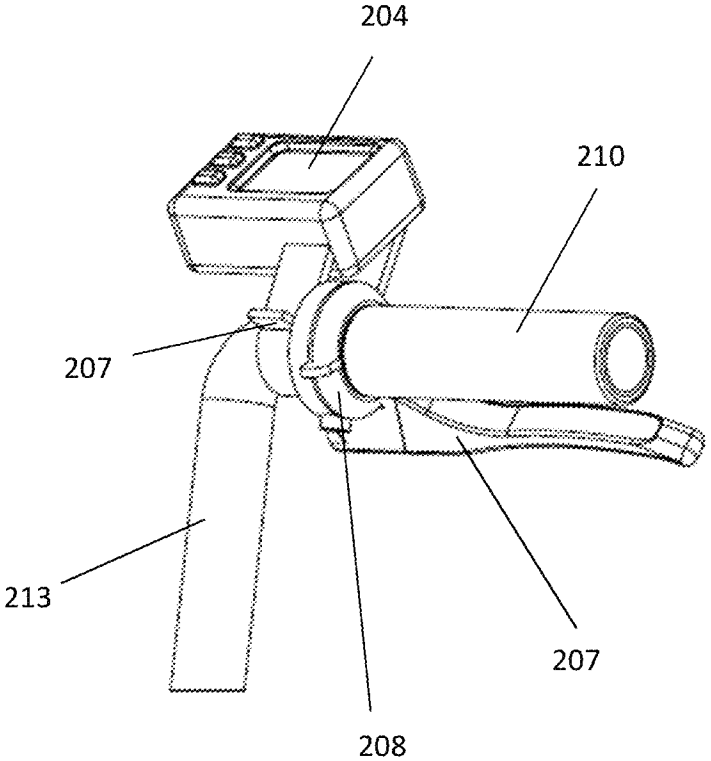
FIG. 2C shows an isolated view of the control features described in FIGS. 2A and 2B wherein said control features are mounted on the same handlebar of a direct drive steering column 299. This option is available for the choice of a single column and driver hub.

FIG. 2C shows an isolated handlebar assembly of a direct drive steering column 299 whereon all the controls 204, 207 and 208 are mounted on the same handlebar covered with a handlebar grip 210. This configuration has a driver hub assembly attached to the steering column in the same manner as shown in FIG. 2D.

Figure 2D:
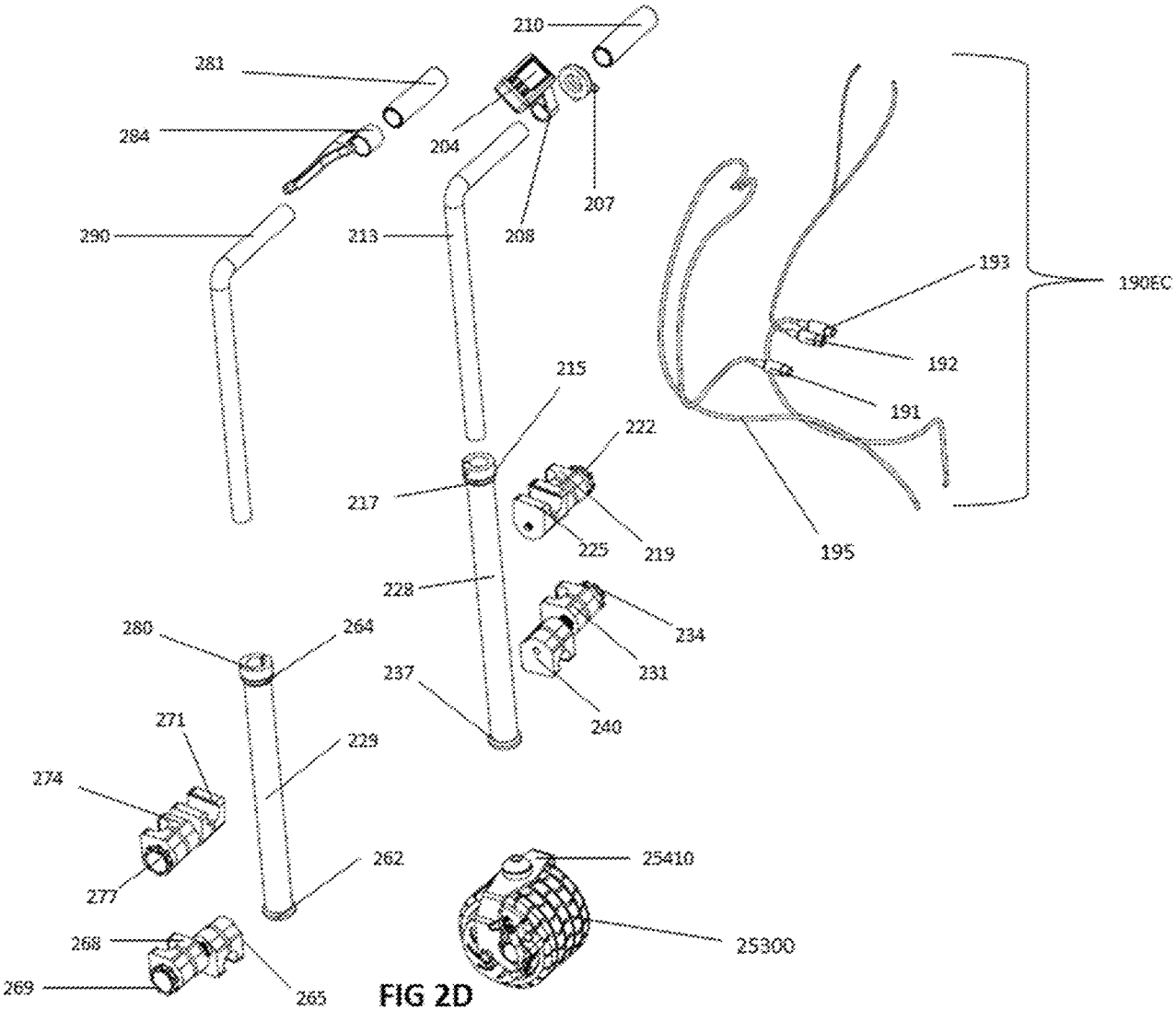
FIG. 2D is an exploded view of the elements of the steering column 201 shown in FIG. 2A, the support column 298 shown in FIG. 2B and the group of electrical and control cables 190 EC.

FIG. 2D shows an exploded view of columns 201 and 298. Support column 298 is assembled and mounted on the wheelchair 100 by first affixing the first clamp assembly 271 to the left upper horizontal strut 108 of the wheelchair 100. This is followed by attaching clamp 265 to the left lower horizontal strut 120 of the wheelchair 100. Then the break handle assembly 284 is slid onto the handlebar section of the piece 290. Then the handgrip is slid on the handlebar 290 to contact the brake handle assembly 284. The vertical section of the handlebar piece 290 is slid into the header tube 280 and may be fixed at a convenient height by tightening the collar 280. Next, the header tube 229 with the handlebar 290 inserted and placed in the openings of 274 and 268 of the clamps already in place on the wheelchair 100. With the steering tube 229 and handlebar 210 inserted at a convenient position, the clamps 274 and 265 are firmly tightened using knobs 277 and 269. A person skilled in the art will perceive that clamping header tubes to the wheel chair struts may be eliminated by permanently attaching said header tubes to the wheelchair horizontal struts. This results in permanently affixing a chosen configuration of the apparatus to the wheel chair and represents a manufacturing option. Steering column 201 is assembled following the same procedure for the strut clamps. Clamp 225 is mounted on the right, top, horizontal strut of wheelchair 100. Clamp 240 is mounted on the right, lower, horizontal strut of wheelchair 100. The header tube 228 is attached to clamp 222 and firmly tightened with knob 222. The header tube 228 is attached to clamp 234 which is firmly tightened by knob 234. The LCD assembly is slid onto the handlebar portion of piece 213. This is followed by the thumb throttle 207 and the hand grip 210. The vertical element of piece 213 is inserted through the header tube 228 and contacts either steering fork connector 25411 affixed to steering fork 25410 on the 25400 external motor driven driver hub assembly or steering fork connector 25313 affixed to steering fork 25311 on the electric driver hub assembly 25300. Said vertical portion of handlebar 213 is fixed in place in relation to the header tube 228 using clamp 215. The driver hub assemblies will be further detailed in subsequent figures. Additional devices may be attached to the handlebar which may provide assistive control by wheelchair users who have compromised hand motor control. These attachments will be detailed and described in FIGS. 8A, 8B, 8C, 8D. 8E, 8F and 8G. This is followed by connecting the control cables to the battery: the brake cable 191 controlling induction braking connects to battery port 191B, the LCD, throttle and reverse switch 192 connects to battery port 192B, the hub wire 193 connects to battery port 193B and hub wire 194 may connect to battery port 194B. The battery ports 191B, 192B, 193B, and 194B are integrated with a voltage controller 206 and are further detailed and described in FIGS. 7B and 7C. The brake mechanical cable 195 connects the brake handle 284 to the brake caliper 25318 shown in FIG. 2E for a single driver. For the option using two driver hubs, a mechanical cable configuration 196 connects the brake handle 284 through joined cables 196 to the two calipers 25318 as shown in FIG. 3J.

Figure 2E:
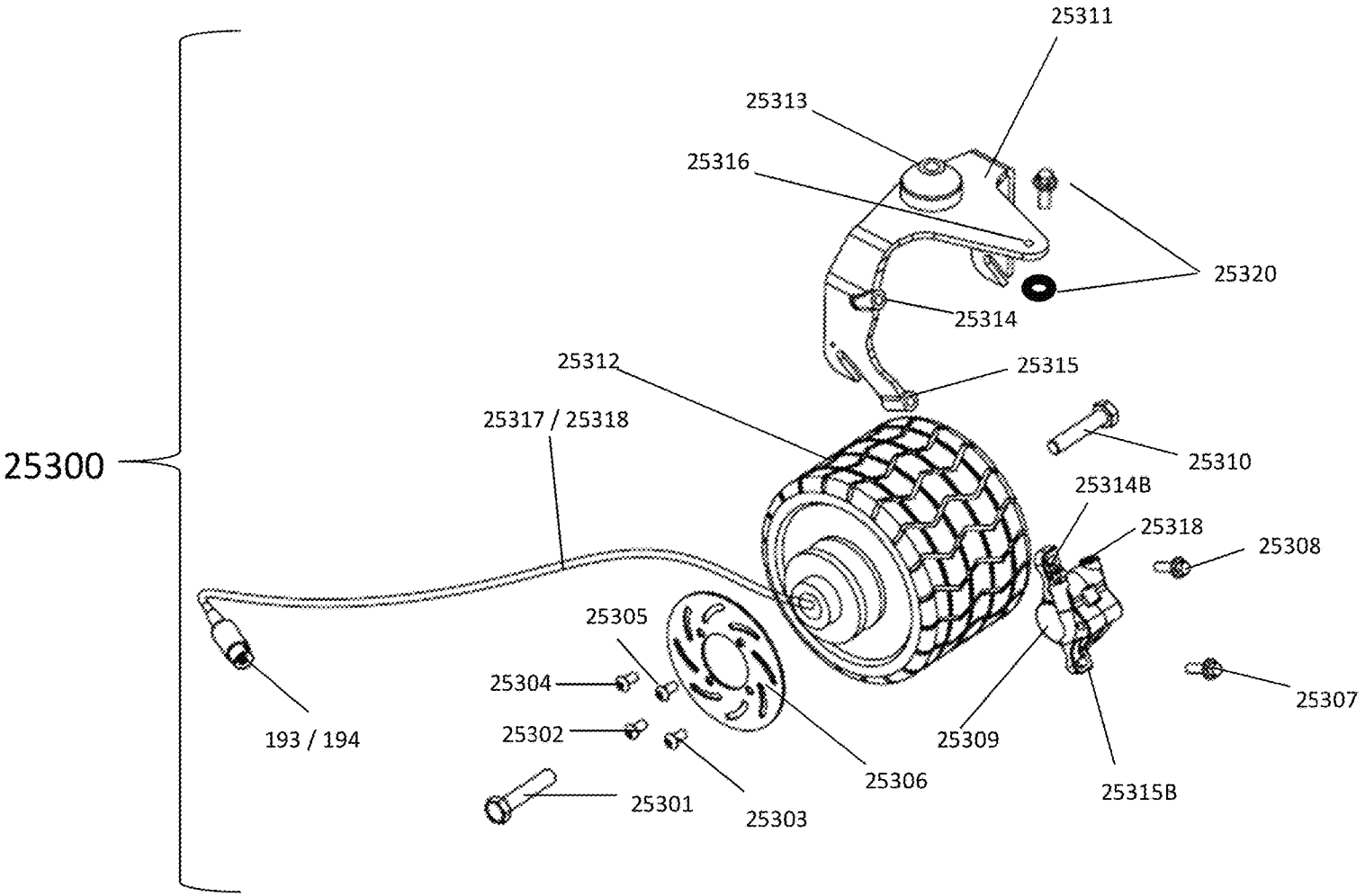
FIG. 2E is an exploded view of electrical driver hub assembly 25300 with all component parts numbered.

FIG. 2E shows an exploded view of the electric driver hub 25300. This driver hub assembly consists of a brake disk 25306 for mechanical braking, a brake disc caliper 25309, and a first, second, third and fourth screws 25302, 25303, 25304 and 25305 which secure said brake disc 35306 to the electric drive hub 25312. The brake caliper 25309 is affixed to the fork 25311 with first and second screws 25308 and 25307. A supplemental braking means may be employed by reversing the electric motor in the driving hub (regenerative braking). This may be accomplished using the same controls affixed to the handlebars. The fork piece 25311 may be affixed to the electric driver hub by first and second screws 25301 and 25310. Alternatively, the fork piece 25410 may be attached to the electric driver hub 25312 by first and second screws 25401 and 25415. Selection of the different fork pieces is determined by the choice of steering means chosen for a particular configuration of the disclosed apparatus. Such configurations will be displayed in subsequent Figures. Alternatively, the brake disc caliper 25309 is affixed to the fork piece 25410 with first and second screws 25406 and 25407. The fork piece is formed with a central attaching means 25313 previously described. The electrical cable 25317 with connector 193 directed to a single electrical driver hub 25300 provides motive power under control. A second electrical cable 25318 with connector 194 may be used to power a second electrical driver hub placed on the opposite side of the wheelchair 100 than the first driver hub.

Figure 2F:
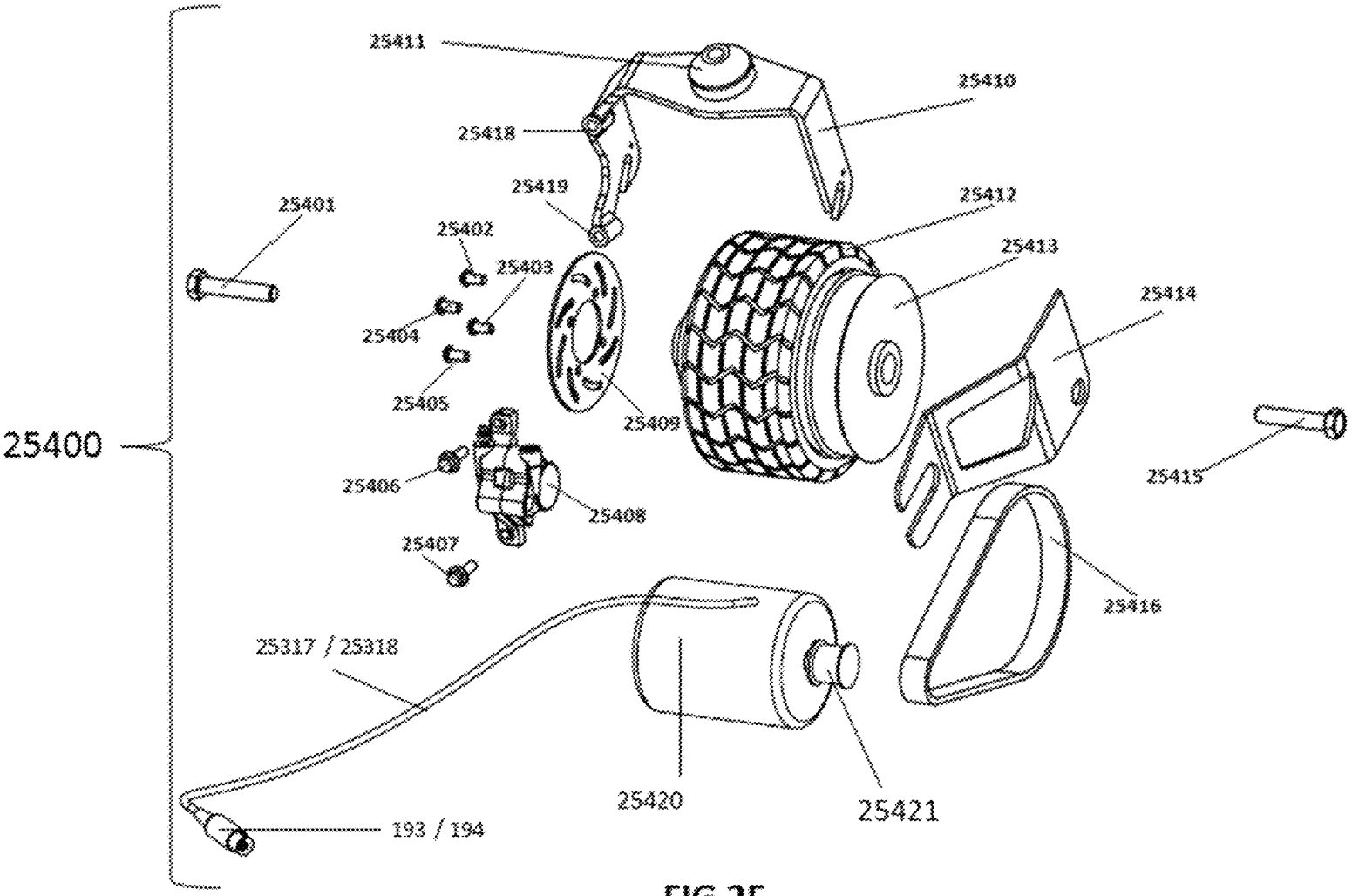
FIG. 2F is an exploded view of driver hub assembly 25400 with all component parts numbered. This assembly shows an external motor driving the motive wheel 25412 with belt and pulley means. The person skilled in the art will recognize that either driver hub assembly 25300 or 25400 may be affixed to steering column 201 as a single motive wheel.

FIG. 2F shows an exploded view of a motor driven hub 25400. In this configuration, motive power is provided by an external motor 25420 driving a pulley 25421 which in turn drives belt 25416 which in turn drives a pulley on the drive motor 25413. The external drive motor 25420 is secured to the drive assemble 25400 by bracket 25414. The braking and steering means are as described in FIG. 2E.

Figure 2G:
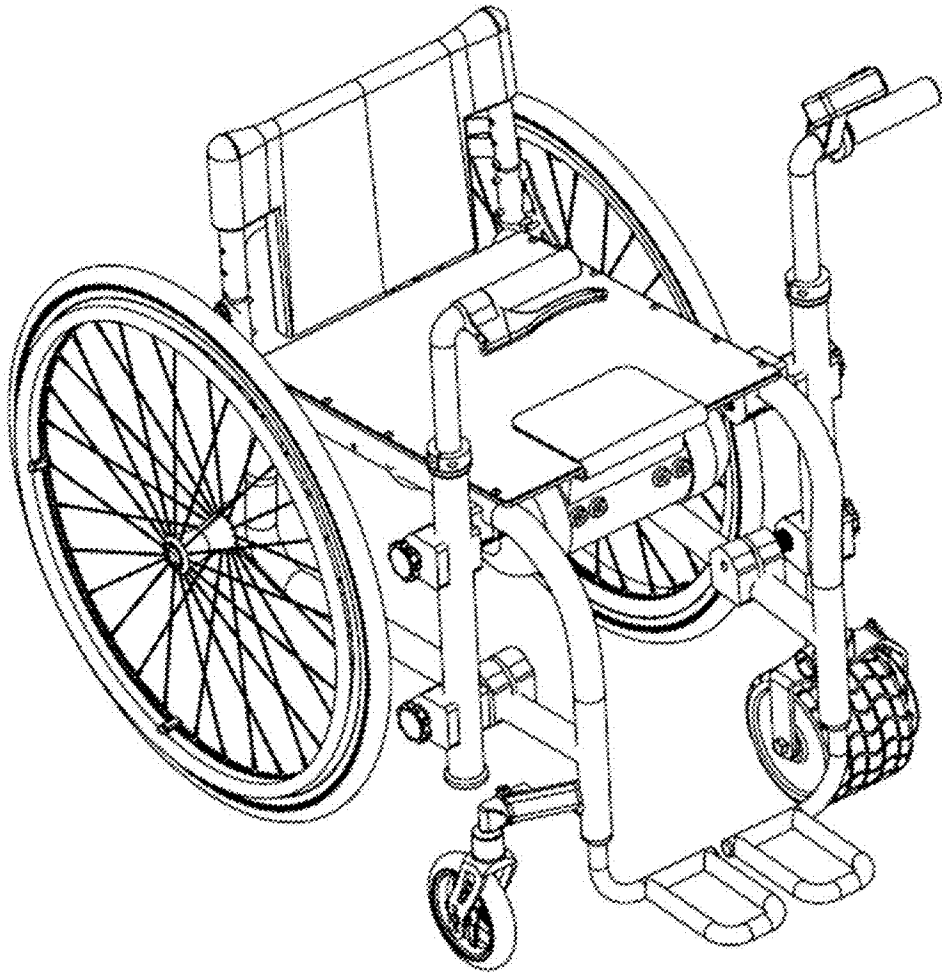
FIG. 2G is a perspective view of a wheelchair 100 with one of the combinations of the disclosed apparatus affixed to the wheelchair wherein a steering column with the LCD assembly and thumb throttle are mounted on the steering column handlebar with the steering column mounted on the right side of the wheelchair and with a support column mounted on the left. In this combination the steering column has an attached electric driver hub assembly 25300.

FIG. 2G shows a perspective view of one of the combinations which was initially described in FIG. 2A. This is the view of a direct drive option of one of the combined features of the invention. This view also shows control and monitoring features including a thumb throttle 207 and LCD monitor and forward/reverse switch assembly 204 and 208 mounted on the right column handle bar, a brake handle284 mounted on the left column handle bar covered by hand grip 281 with power and control cables and the battery 190 in its mount 180 at the front of the chair seat 170. The control and brake cables are attached as described in FIG. 2D. Additional examples of combinations of elements and features comprising powered and controlled attachable units will be further displayed in subsequent figures which will include number designations for the various parts of the disclosed parts of the invention.

Figure 2H:
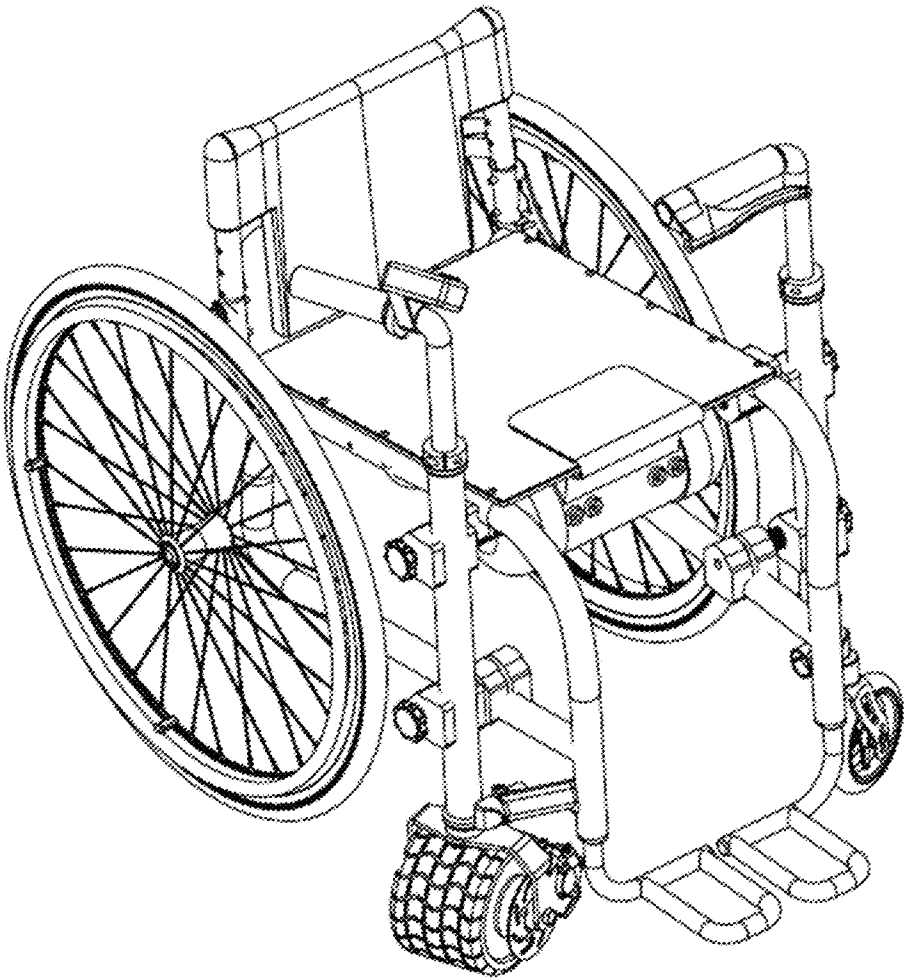
FIG. 2H is a perspective view of the wheelchair configuration shown in FIG. 2G where the driver hub is turned to the right with a corresponding movement of the handlebar.

FIG. 2H shows a perspective view of the disclosed apparatus of FIG. 2G mounted on a wheelchair 100 with a variant of the right driver hub assembly 25300 using fork 25410 turned to the right and with co-moving left and right caster wheels. The control cables are not shown.

Figure 2I:
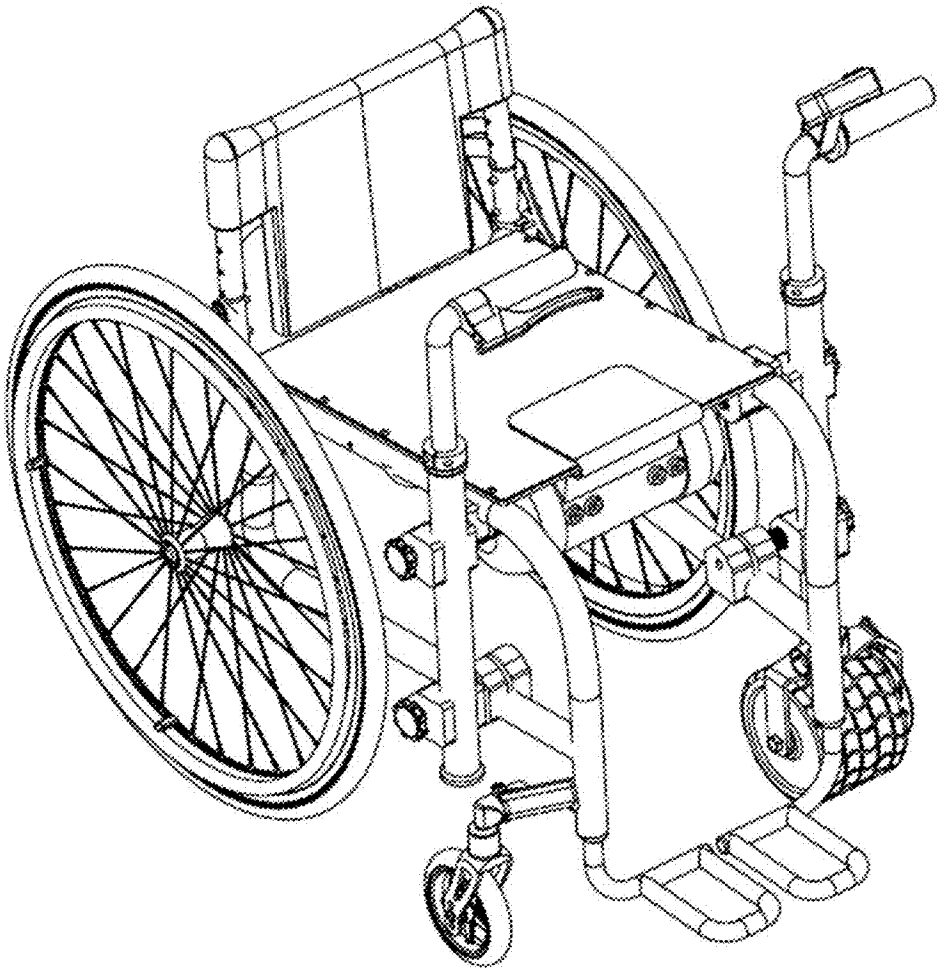
FIG. 2I is a perspective view of a wheelchair configuration where the steering column with electrical driver hub is mounted on the left of the wheelchair and a support column is mounted on the right

FIG. 2I shows a perspective view of the disclosed apparatus with a steering column 201 with attached variant of wheel driver hub assembly 25300 using the fork 25410 mounted on the left of the chair with the LCD control and throttle mounted on the left column and with the control cables not shown. In this figure, the brake handle is mounted on the handlebar of the support column 298 mounted on the right of the wheelchair 100.

Figure 3A:
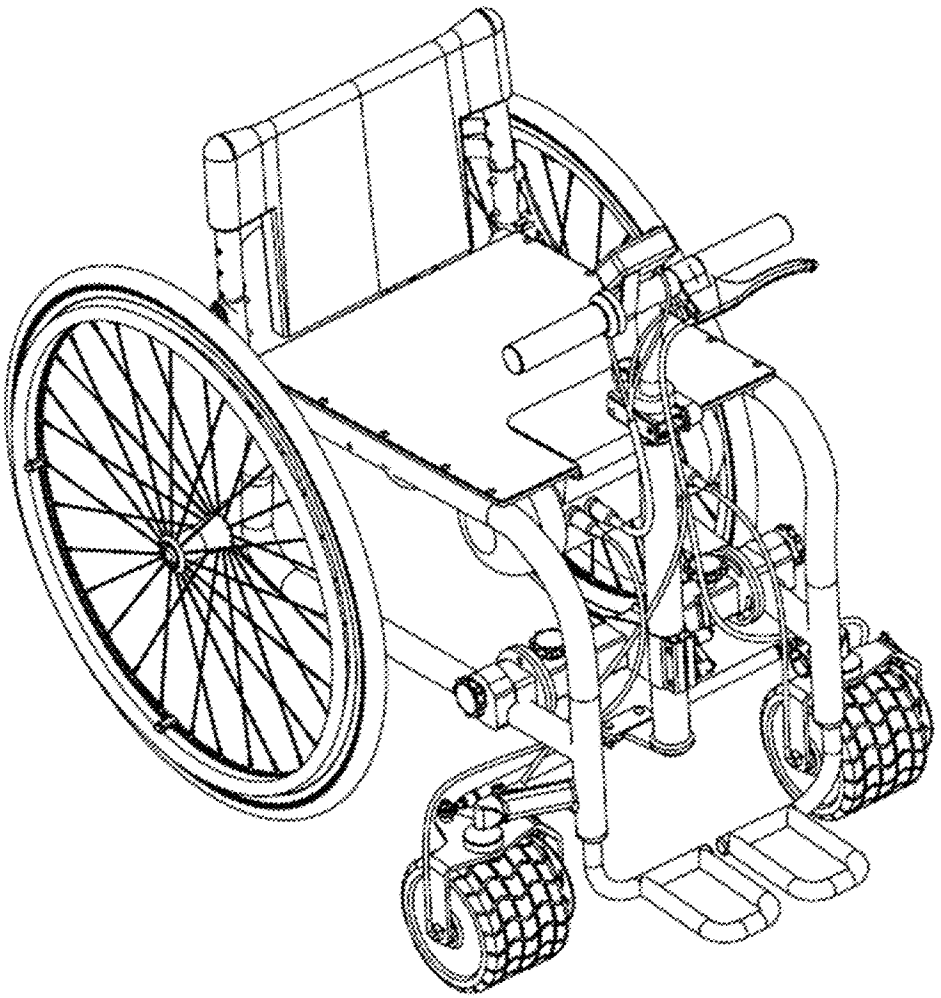
FIG. 3A is a perspective view of an alternative configuration of the disclosed apparatus comprising a center positioned control column affixed to the wheelchair by a crossbar clamped to the lateral bottom struts of the chair.

FIG. 3A is a perspective view of an alternative configuration which may be assembled from the disclosed apparatus comprising a center positioned control column 300A, as later described, affixed to the wheelchair by a crossbar 460 clamped to the lateral bottom struts of the chair 110 and 120. FIG. 3A additionally shows a first 25300 and second 25300 driver hub assembly mounted on the right and left of the wheelchair and the steering control linkage 420 with the steering column as shown in FIGS. 3E and F controlling the direction of the hubs and the linking control cables. This configuration, as with others disclosed, may be made permanently attached to the wheel chair. The individual components comprising this configuration and other variants will be further detailed and described in subsequent figures.

With the utilization in the disclosed invention of a motive configuration that does not lift the caster wheels when the motive driver hub or hubs contacts or contact the driving surface, cross linked steering and improved control features as described in FIG. 2A and following, this configuration is a separate and distinct improvement over the apparatus described in U.S. Pat. No. 8,684,113, "Attachable, powered drive apparatus for wheelchairs."

Figure 3B:
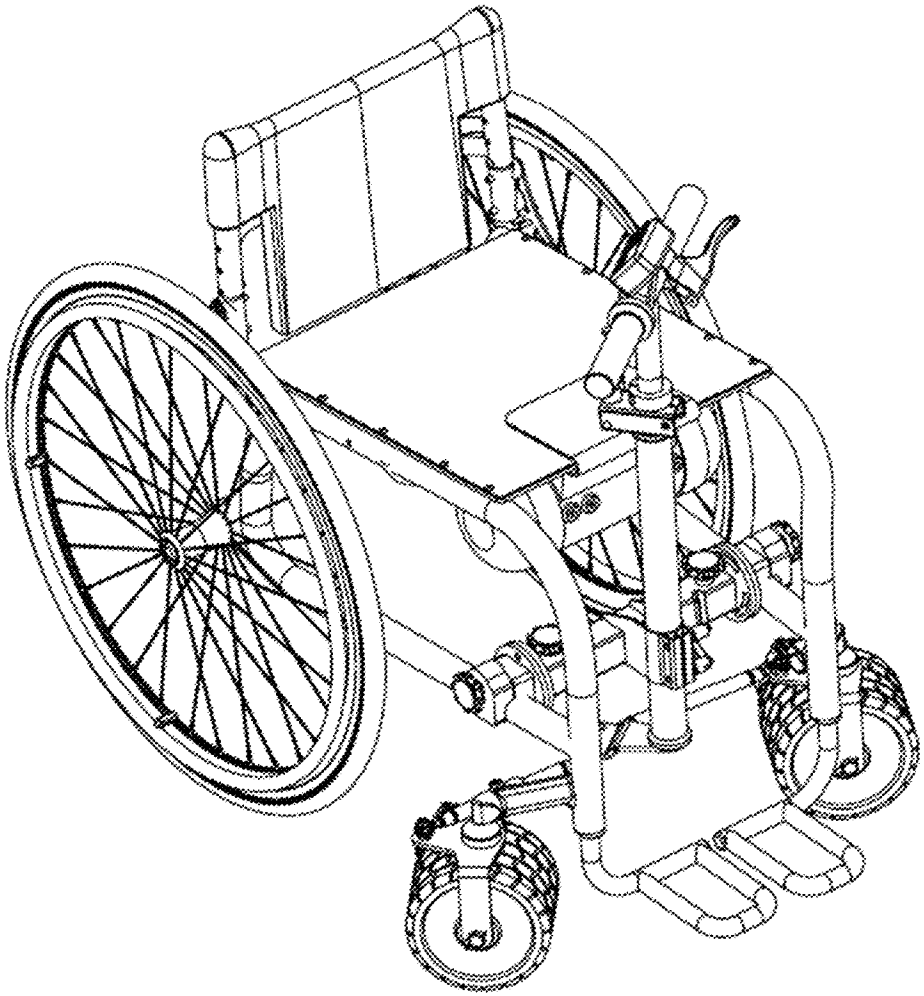
FIG. 3B is a perspective view of the chair shown in FIG. 3A with the driver hubs turned to the left and the corresponding rotation of the handlebars.

FIG. 3B is a perspective view of the chair shown in FIG. 3A with the driver hub assemblies turned to the left and the corresponding rotation of the handlebars.

Figure 3C:
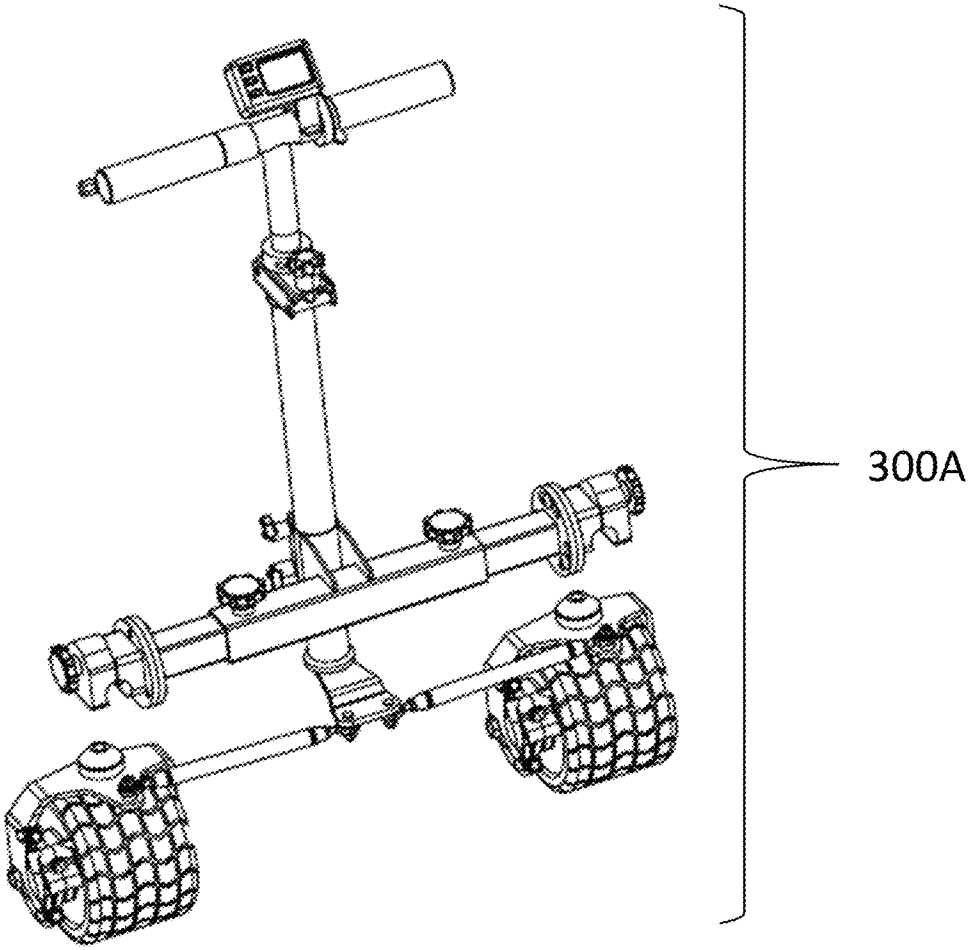
FIG. 3C is an isolated view of the control column 300A shown in FIG. 3A showing the handlebars, clamping cross bar, dual steering linkages and driver hubs.

FIG. 3C is an isolated view of the control column 300A shown in FIG. 3A showing the handlebars, clamping cross bar, steering linkages, left and right driver hub assemblies, control and braking cables, the LCD monitor, thumb switch controlling forward and reverse direction of the driver hub assemblies and the brake handle.

Figure 3D:
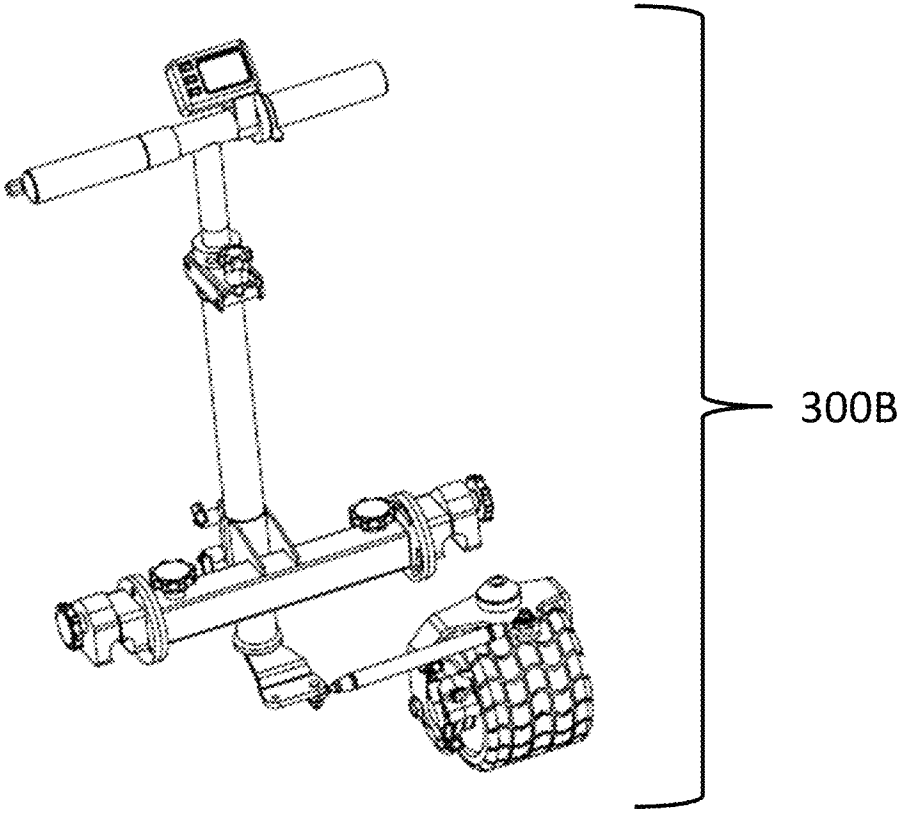
FIG. 3D is an isolated view of an alternative configuration of the disclosed apparatus with central steering and one driver hub which may be configured on either the left or right side of the wheelchair. In this FIG. 3D the driver hub is mounted on the right.

FIG. 3D is an isolated view of a center steer configuration 300B with the driver hub assembly mounted on the driver's right. Alternatively, the driver hub assembly may be mounted on the left.

Figure 3F:
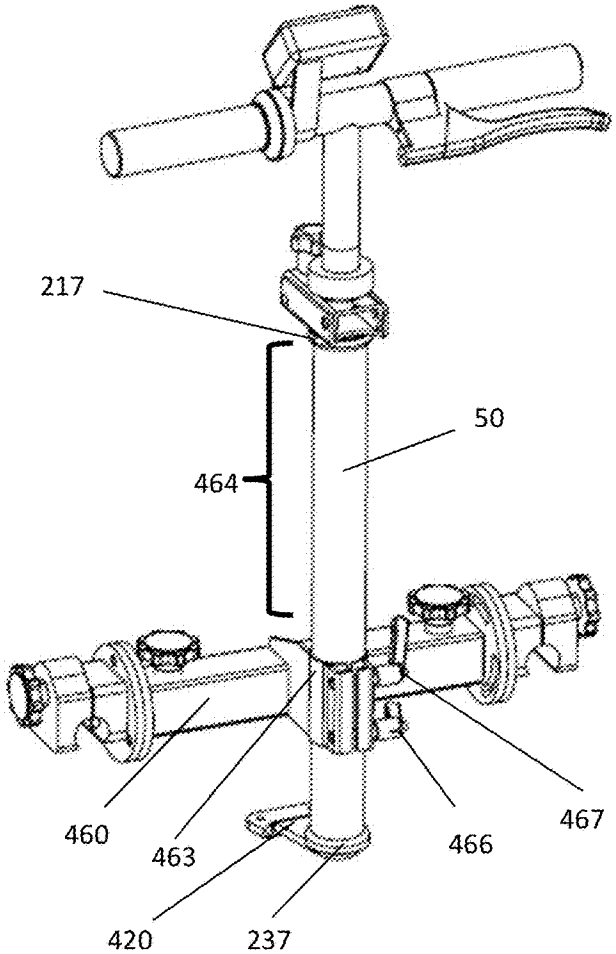
FIGS. 3F is an isolated view of the central control column and crossbar used to attach the apparatus to the wheelchair with numbered elements of the apparatus and with the crossbar in a lowered position.
Figure 3E:
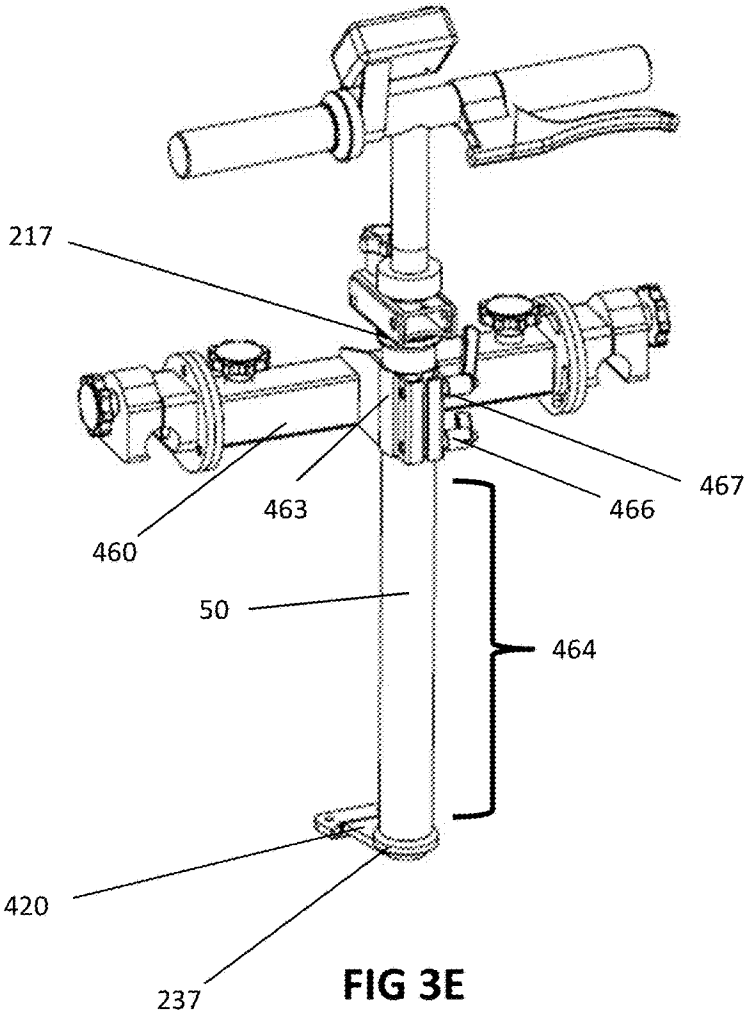
FIG. 3E is an isolated view of the center control column and crossbar used to attach the apparatus to the wheelchair with numbered elements and with the crossbar in an upward position illustrating the accommodation of the apparatus to different configurations of the wheelchair structure.

FIGS. 3E and 3F show isolated views of the central control column 300A with the crossbar 460 in two different positions and with numbered elements of the apparatus. The crossbar 460 slides vertically on the header tube 50 and may be locked in position with clamp assembly 463 using upper clamp 467 and lower clamp 466.

Figure 3G:
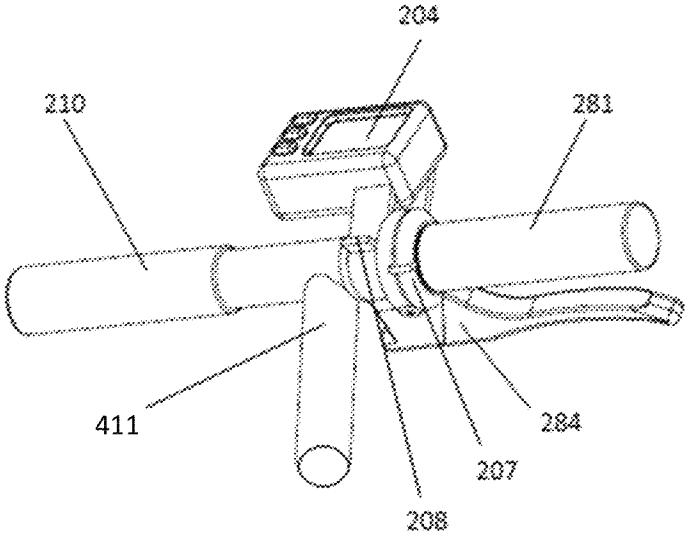
FIG. 3G is a view of the LCD monitor assembly including the forward/reverse switch, the brake handle and the thumb throttle mounted on a center steer handlebar.

FIG. 3G shows an isolated view of the center steer handle bar assembly 410 with first 210 and second 281 hand grips, LCD monitor assembly 204 with, forward/reverse control 208, thumb throttle 207, brake handle 284 with the perpendicular extension 411 of handle bar piece 410 descending to contact the center steer tilting assembly 80. The center steer tilt assembly rests upon upper bearing 216 affixed to the top of the header tube 50.

Figure 3H:
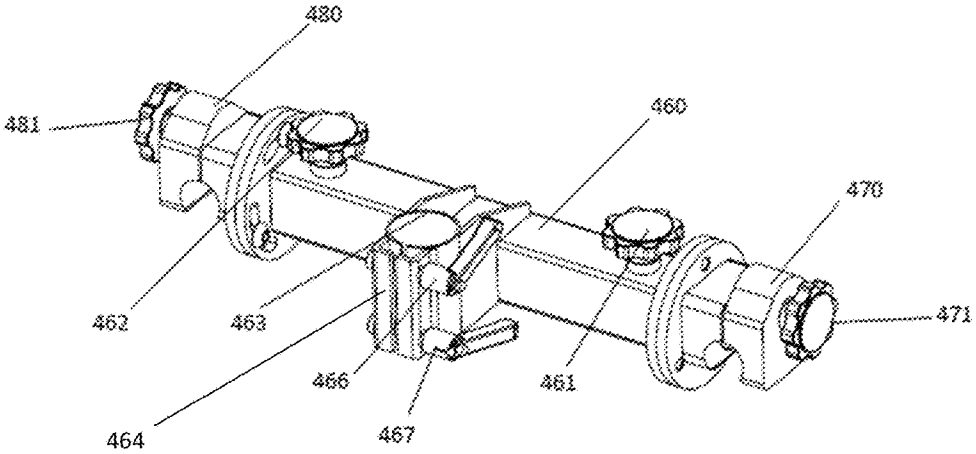
FIGS. 3H and 3I are isolated views of the crossbar 460 shown in FIGS. 3A, B, C, and following showing the adjustability of said cross to accommodate different wheelchair structures.
Figure 3I:
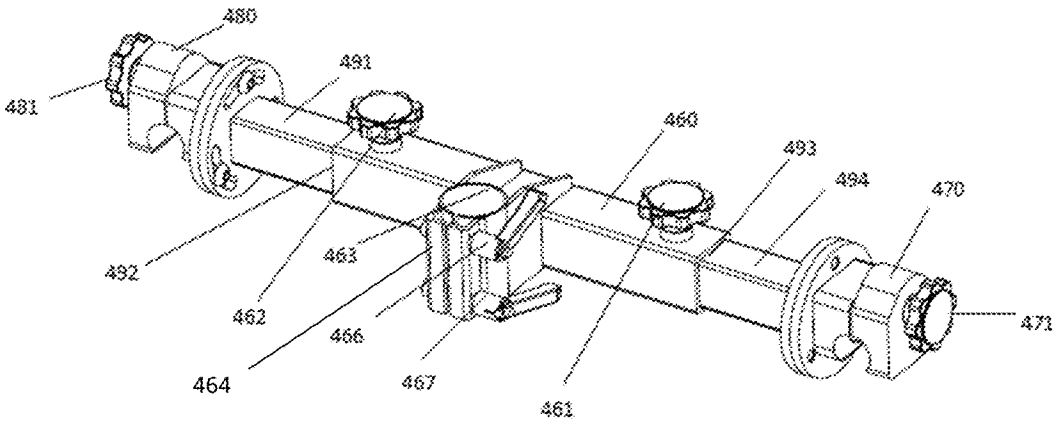
Figure 3J:
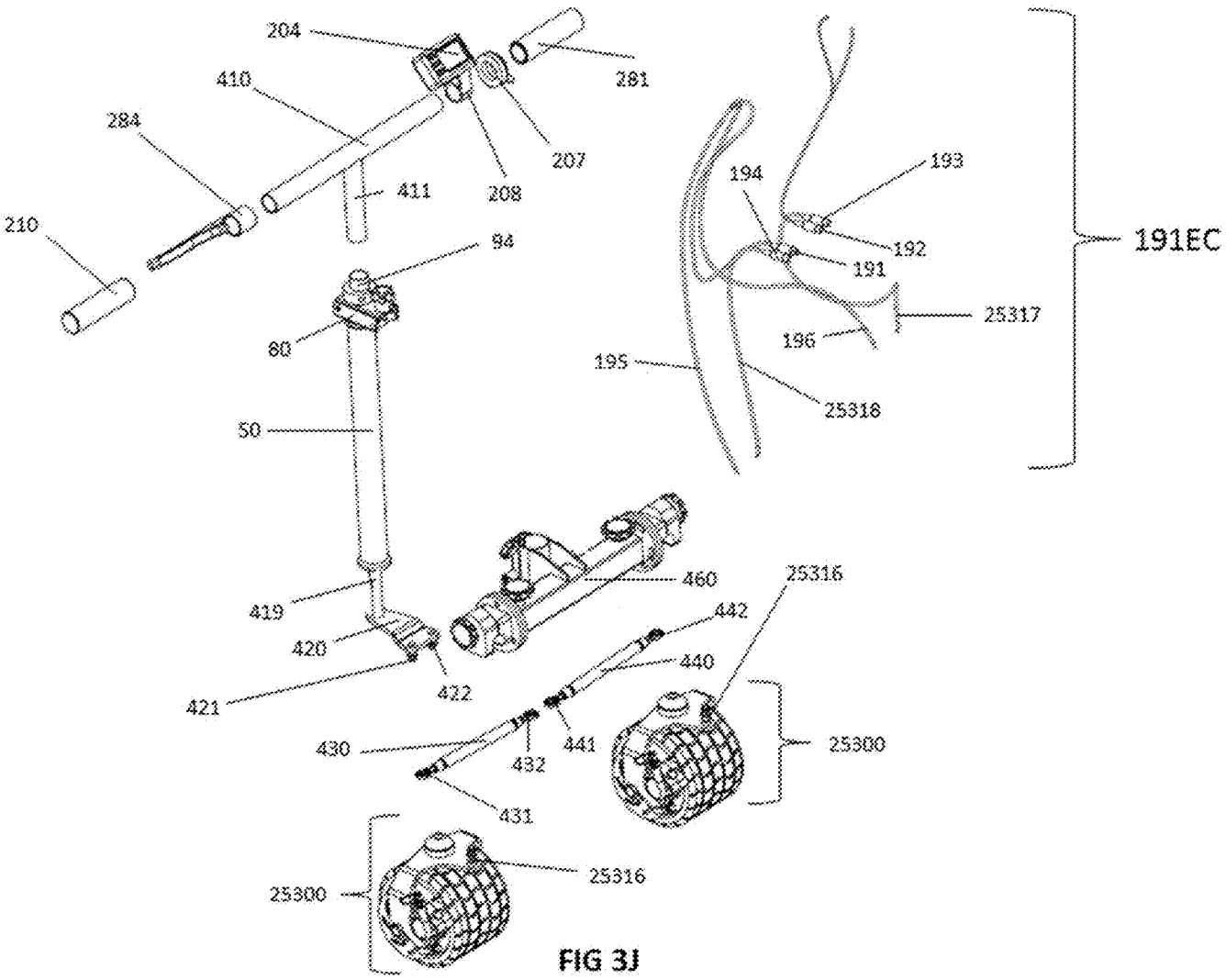
FIG. 3J is an exploded view of the central steering apparatus electrical and brake cables 191EC.

FIGS. 3H and 3I show perspective views of the center crossbar 460 which will be affixed to the lower horizontal struts of the wheelchair 100. Here, clamp 480 is affixed to the right lower horizontal strut 110 and tightened with knob 481. Clamp 471 is affixed to the left lower horizontal strut 120 and tightened with knob 471. FIG. 3H shows the crossbar 460 in its most contracted position. FIG. 3I shows the crossbar extended with first shaft 491 extended from the center body 492 and fixed in position with tightening knob 462 and with shaft 494 extended from center body 492 and tightened in place with knob 461. Affixed to the center of crossbar 460 is the cut cylinder tube assembly 463, configured to fit over header tube 50 and tightened around said header tube 50 using first cylinder clamp 466 and second cylinder clamp 467.

FIG. 3J is an exploded view of the center control column 300A controlling the two driver hub assemblies of the same kind, 25300. The wiring and cables for electrical and braking control of said center control column are displayed in FIG. 7B. Said column 300A is assembled by fitting on the brake handle 284 on the left handlebar extension of piece 410. This is followed by fitting on the hand grip 210 over the left handlebar. The LCD assembly 204 with the forward/reverse switch 208 is fitted on the right handlebar of piece 410 followed by fitting the thumb throttle 207 over the right handlebar and, lastly, fitting on the hand grip 291 over the right handlebar. Piece 410 has a tube 411 perpendicularly extending downward from its center. Tube 411 is slidably inserted into fitting 94 part of the tilt assembly 80. This assembly is shown in more detail in FIGS. 4B and 4C. Tube 411 is fixed in fitting 94 after insertion by tightening collar 412 using tightening screw 413. An isolated view of this stage of the assembly is shown in FIG. 3H. The center steer tilting assembly 80 is affixed at the top of header tube 50. The header tube 50 is passed through the cut cylinder tube 463 which is part of the cut cylinder tube assembly 264 as previously shown in the details of FIGS. 3I and 3J. The vertical placement of header tube 50 is maintained by clamping the first 466 and second 467 cylinder clamps, the bottom bearing assembly 236 is affixed to the bottom of header tube 50. The top 216 and bottom 236 bearings on the header tube 50 are shown in more detail in FIG. 4A. The header tube 50 is then placed upon and fixed to the tubular projection 419. The tubular Projection 419 extends upward from the steering linkage bracket 420 through header tube 50 and enters and is clamped to tube 87 on the lower part of the tilt assembly 80, shown in more detail in FIGS. 4B and 4C. The completion of clamping projection 419 onto tube 87 is accomplished by tightening clamp 416 using tightening screw 415 as shown in FIG. 4B. These steps are followed by connecting the steering linkage bracket 420 to the first 430 and second 440 steering rods. Joint 421 of the steering linkage bracket 420 is bolted to the inner end 432 of the left steering linkage 430. Joint 422 of the steering linkage bracket 420 is bolted to the inner end 441 of the right steering linkage 440. The outer end 431 of the left steering linkage 430 is bolted to the left driver hub containment bracket at opening 25311. In the same way, the outer end of the right steering linkage 440 is bolted to the right driver hub containment bracket at opening 25316. The person skilled in the art will note that the first and second electric driver hub assemblies 25300 are identical and that these electrical driver hubs are suitable for single or dual drive hub assembly configurations in either direct drive configurations as shown, for example in FIG. 2A and following or with cross linked steering as shown in FIG. 3J. It will also be readily understood by one skilled in the art that the driver hub assembly 25400 employing an external motor is only suitable for a direct drive steering configuration such as those depicted in FIG. 2A and following. It will also be clear to one skilled in the art that the means for fastening tube 411 to the tilt mechanism 80 and the additional fastening of extension 419 to the tilt mechanism 80 results in a unified structure that will turn on the bearings of header tube 50 so that rotation of handlebar 410 and extension tube 419 inside header tube 50 results in parallel rotation of steering linkage bracket 420 which in turn controls turning of the left and right driver hub assemblies 25300 to steer the wheelchair 100. The wiring and brake cables shown in FIG. 3J will be further explained in the discussion of FIGS. 7A and 7B which show connections to the battery 190. The person skilled in the art will observe that there are four kinds of electrical cables and associated connectors which are necessary to power the dual driver hub assemblies shown in FIG. 3JK as opposed to the three cables and connectors shown in FIG. 2D where a single driver hub assembly requires power along with the brake 284, LCD monitor assembly 204 and 208 and thumb throttle 207. Similarly the brake cable 195 for braking a single hub is differentiated from cable 196 for baking dual hubs.

Figure 4A:
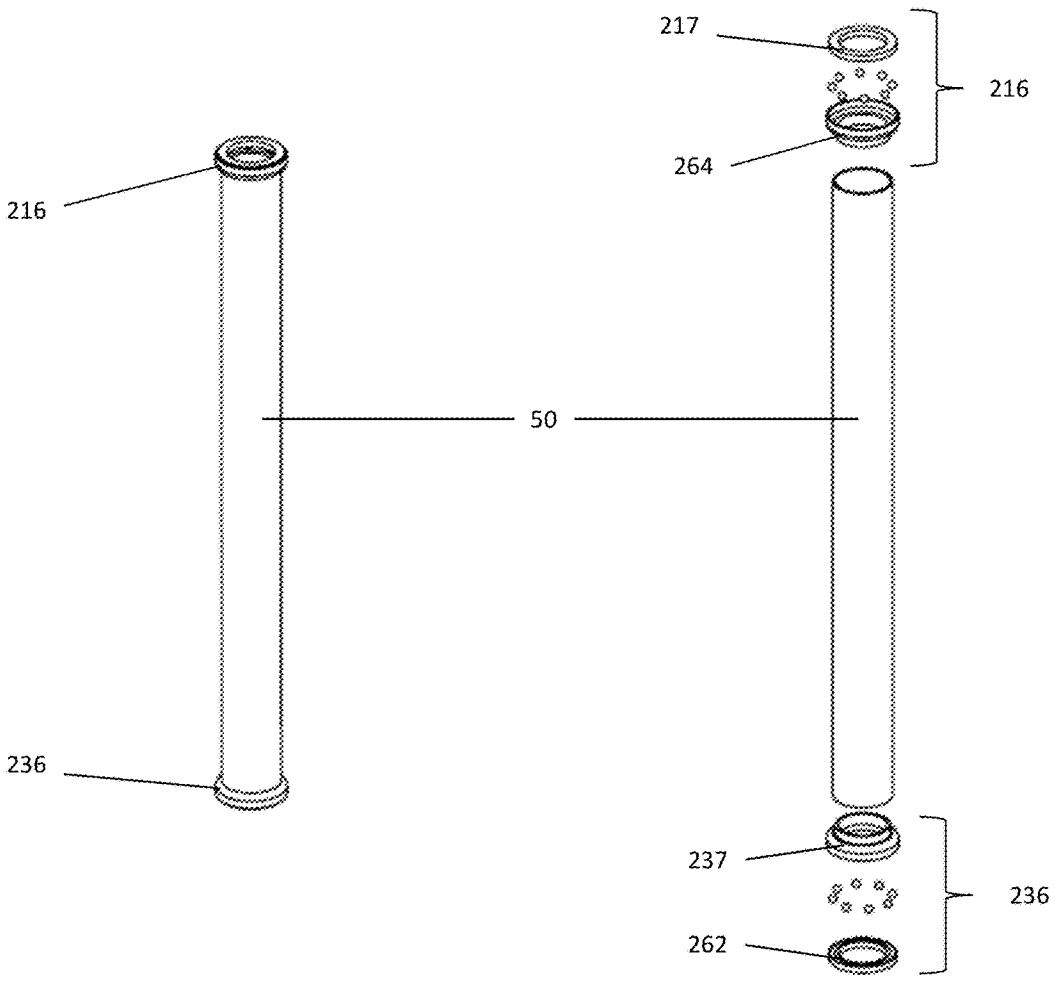
FIG. 4A shows two exploded views of the header tube 50 forming an element of the center steering mechanism including an exploded view of the bearing assemblies mounted on the top and bottom of said header tube.
Figures 4B, 4C:
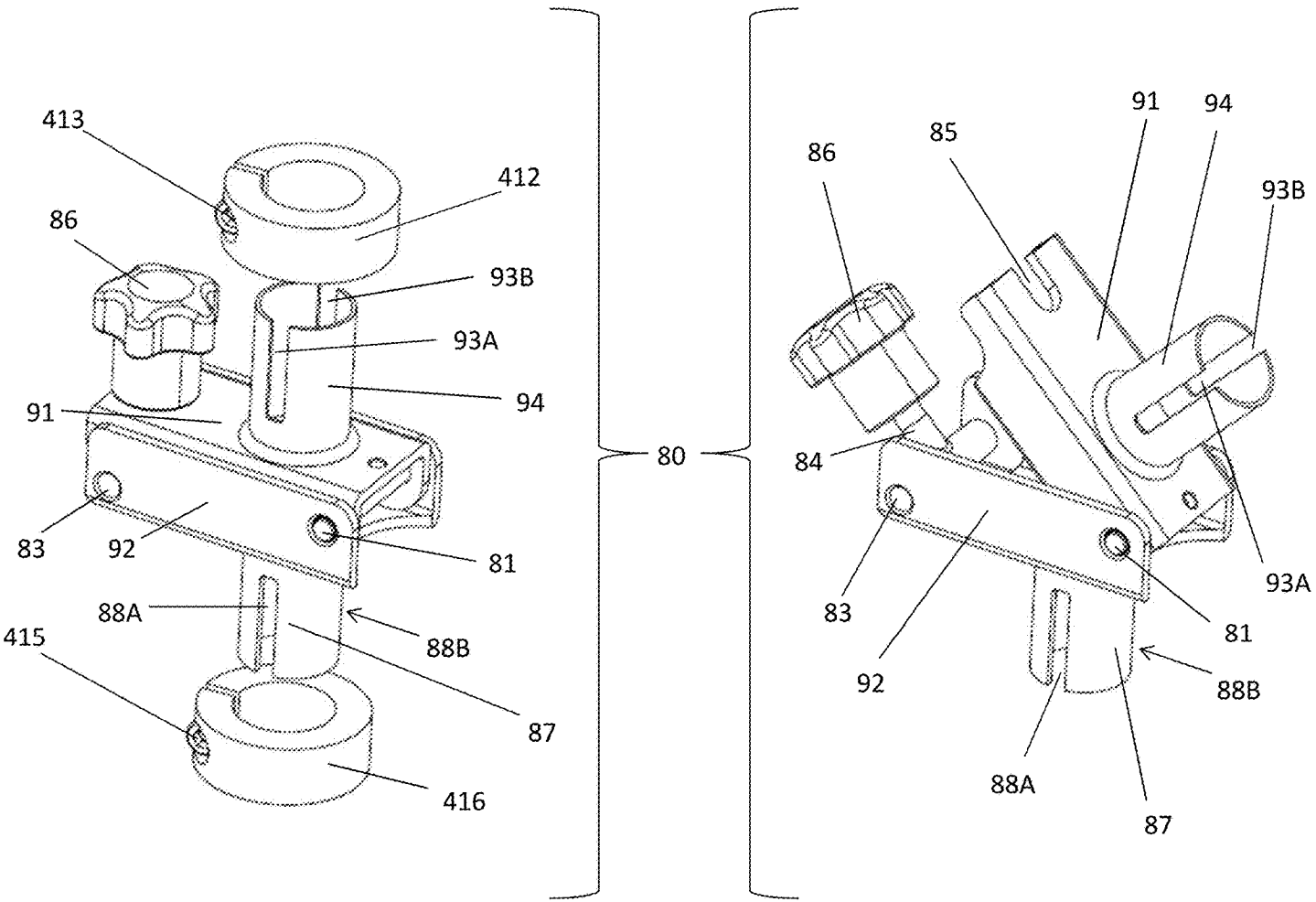
FIGS. 4B and 4C are exploded views of the tilt mechanism 80 facilitating fixture in place of the desired length of the vertical section of the handlebar piece, fixture in place with the desired length of the vertical extension of the steer connection platform, described in later figures, and rotation in a vertical plane of the upper portion of the steering column to facilitate mounting and dismounting from the wheelchair.

FIG. 4A is a dual view of header tube 50. The left view shows the header tube with a first bearing assembly 216 affixed to the top and a second bearing assembly 236 placed at the bottom. The right view shows the bearing 216 assembly separated into its component parts comprising an upper ring 217 and a lower ring 264 comprising a bearing race in which are placed a plurality of ball bearings. The lower ring 264 is press fitted into the upper end of the header tube 50 and is fixed in place. The upper ring 217 contacts the lower ring 264 thus enclosing the ball bearings in the bearing race so that when the lower ring 264 is affixed to the top of header tube 50 the upper ring 217 may rotate freely thus enabling the tilt assembly 80 contacting the upper bearing 216 to freely rotate as controlled by the rotation of the handlebar 410. The bottom bearing 236 comprises an upper ring 237 which is press fitted into the lower end of header tube 50 and a lower ring bearing race 262 which when contacting the upper ring 237 holds a plurality of ball bearings in place. In assembly, the lower bearing assembly 236 is held in place manually while the whole steering assembly comprising handlebar 410, tilt assembly 80 and extension tube 419 inserted through the header tube 50 is fitted together and contacts the steering linkage bracket 420. Thus, when the lower bearing 236 contacts the steering linkage bracket 420, the steering assembly comprising handlebar 410, the descending projection 411, the tilt assembly 80, and the steering platform extension 419 is free to rotate with the advantage of low friction enabled by the bearings 216 and 236.

FIG. 4B is an isolated view of the tilt assembly 80 in the dosed position showing the first, upper tightening ring 412 and the tightening screw 413 which fits over the upper tube 94 constructed with open slots 93A and 93B4 which allow compression of tube 94 when tightened by ring 412 to secure the handlebar extension 411 to the upper tube 94. Tube 94 is affixed to the upper portion 91 of the tilt assembly 80. The upper portion 91 of the tilt platform is rotatably joined to the lower portion 90 of said tilt assembly 80 by pin 81 enabling the upper portion 91 of the tilt assembly to rotate in a vertical plane. The upper portion 91 of tilt assembly 80 fits precisely into the lower portion 90. The lower portion 90 of the tilt assembly 80 rests upon the upper bearing 216 of header tube 50, shown in FIG. 4A, so that the tilt assembly may rotate freely thereupon. Tube 87 extends downward from the lower portion 90 of the tilt plane assembly 80. The vertical extension 419 is directed upward from the steering linkage bracket 420. Said extension 419 is fixed in tube 87 using clamp 416 tightened with screw 415 to compress slots 88A and 88B.

FIG. 4C is a perspective view of the tilt assembly 80 in the open position where the upper plate 91 is rotated vertically away from the bottom plate 92 pivoting on cross pin 81. The head of the clamping pin 86 is threadably connected to extension 84 and may be screwed up or down on extension 84. Extension 84 is perpendicularly joined to the cross pin 83 which rotatably traverses the sides of the bottom plate 92. To open the top 91 and bottom 92 plates from the closed position, the head of the clamping pin 86 is rotated in a counter-clockwise manner which pulls the face of the clamping pin away from contact with the upper plate 91. The clamping pin is then rotated away from the tilt assembly wherein the upper plate 91 is free to rotate away from the bottom plate 92. To close and secure said top and bottom plates, the top plate 91 is rotated toward the bottom plate 92 until closure is achieved. The clamping pin is then rotated toward the U-shaped opening 85 in the top plate 91 and the head of the clamping pin is rotated in a clockwise manner until the head of said clamping pin contacts the top plate 91. Opening and rotating the top plate of the tilt plate assembly allows the steering assembly previously described to rotate forward away from the wheelchair 100 which facilitates access to and egress from the wheelchair by the user.

Figure 5A:
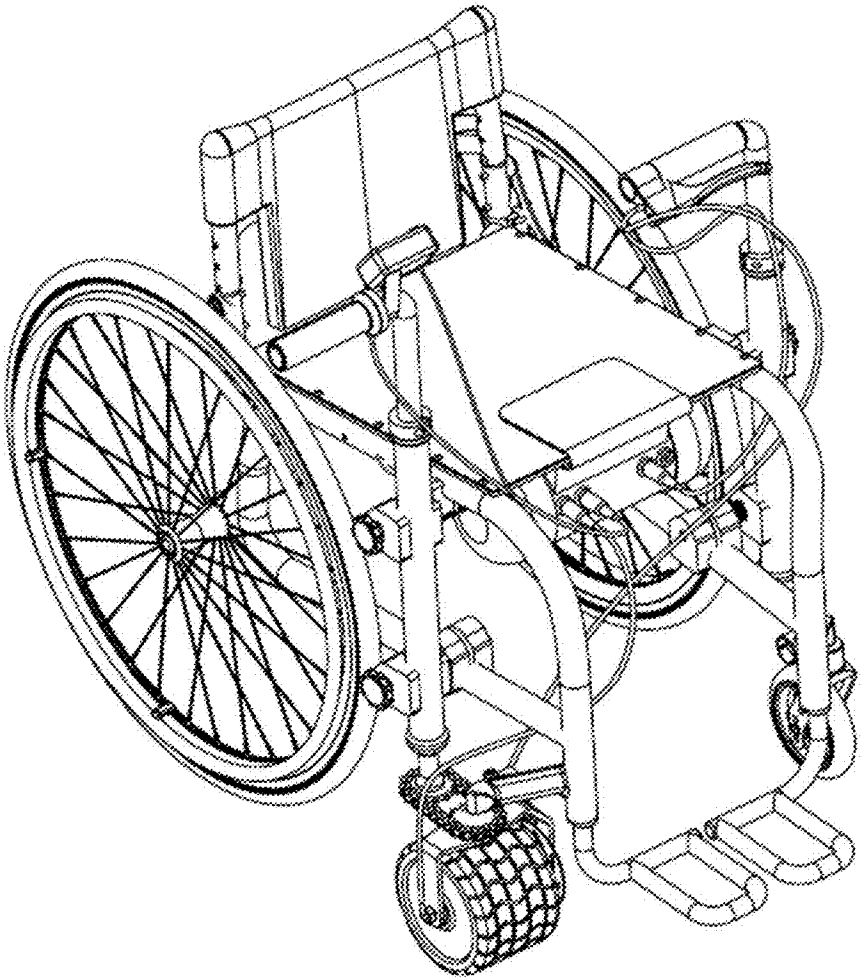
FIG. 5A is a perspective view of a wheelchair with a steering column mounted on the right, a support column mounted on the left where said steering column is attached to a chain drive assembly which controls the right/left rotation of the driver hub. Control cables are also shown as is the caster wheel control arm used to attach and stabilize the driver hub.

FIG. 5A is a perspective view of wheelchair 100 with chain and sprocket steering for a direct drive column 201C as would be seen from the wheelchair occupant's view. The support column 298 is the same as shown in FIG. 2B. The controls, cables and battery are as shown in FIG. 2D. The placement of the steering column 201C and the support column 298 are akin to the configurations shown previously.

Figure 5B:
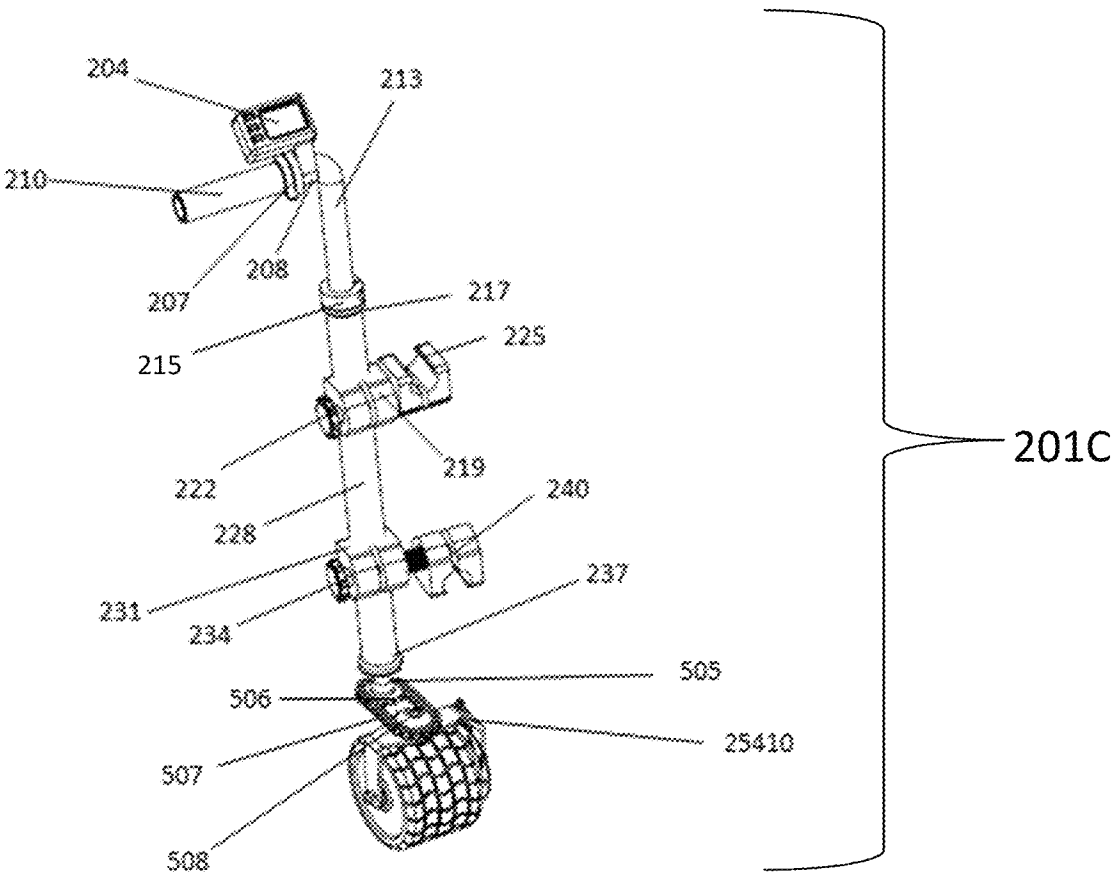
FIG. 5B is an isolated view of individual steering column with the component parts numbered. The support column, not shown, is the same as previously described.

FIG. 5B is an isolated view of the steering column 201C terminating in a chain steered 507 hub driver assembly 25300 attached to and stablilized by a caster arm as shown in assembly 149 in FIG. 5A.

Figure 5C:
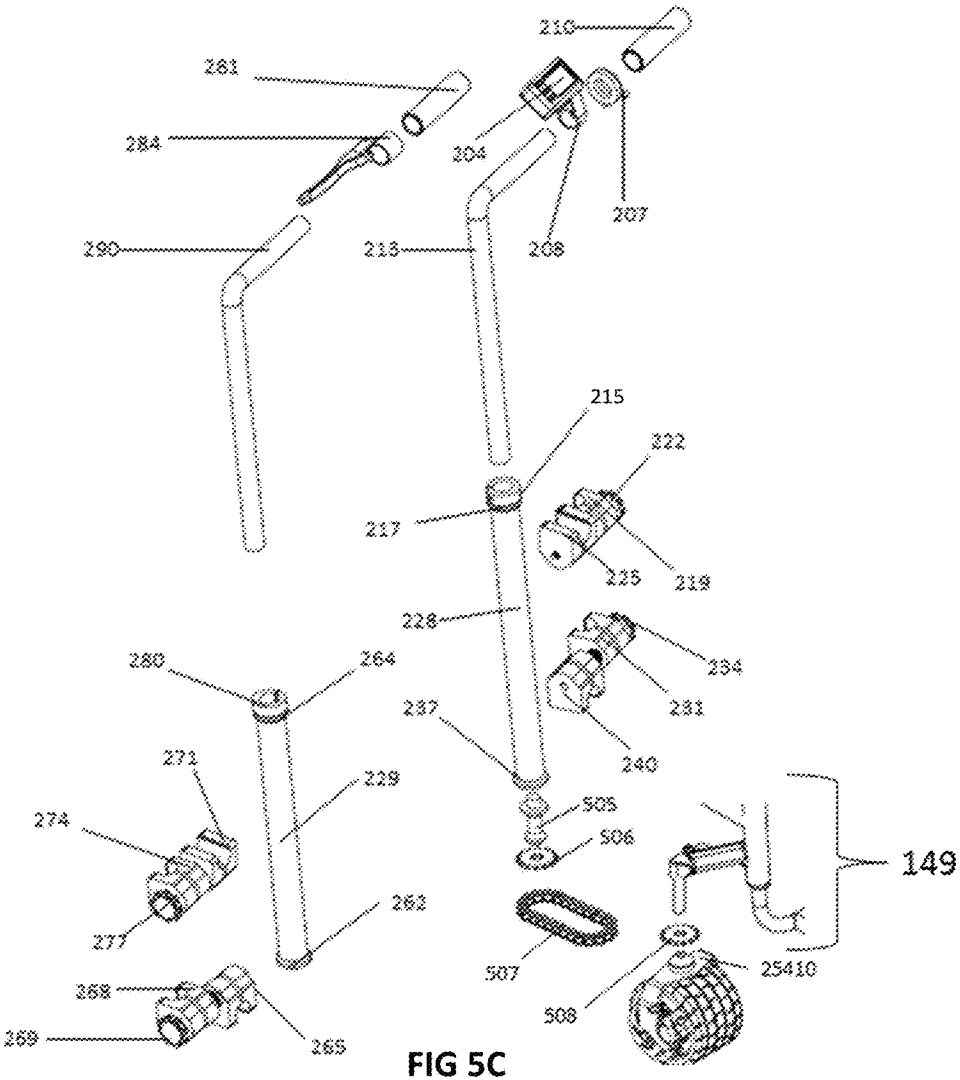
FIG. 5C is an exploded view of the steering column with the chain drive steering assembly and the support column as shown in FIGS. 5A and 5B.

FIG. 5C is an exploded view of the apparatus shown in FIG. 5B. Column 201C is assembled by attaching the LCD assembly 204 and 208 forward/reverse switch 208 and thumb throttle 207 to the handlebar portion of piece 213. The clamps 222 and 234 are affixed to the right upper and lower horizontal struts as previously described. Header tube 228 with upper bearing 216 and lower bearing 236 is clamped to the wheelchair as described in FIG. 2D. The vertical extension of handlebar 213 is inserted through the header tube 228 to contact and be attached to the upper end of the steer sprocket bracket 505. The lower end of steer sprocket bracket 505 is affixed to the fork sprocket 506. The fork sprocket 508 is rotatably placed on the steering fork connector—using fork 25410 for either an electrical driver hub assembly 25300 or an external motor driver hub assembly 25400. The right front caster arm 149A from which the right front caster wheel 150 has been removed is then attached to the steering fork connector through the center of the fork sprocket 508 thus stabilizing the driver hub assembly. The steering chain 507 is then fitted and tightened around the steer sprocket bracket 505 and the fork sprocket 508.

Figure 6A:
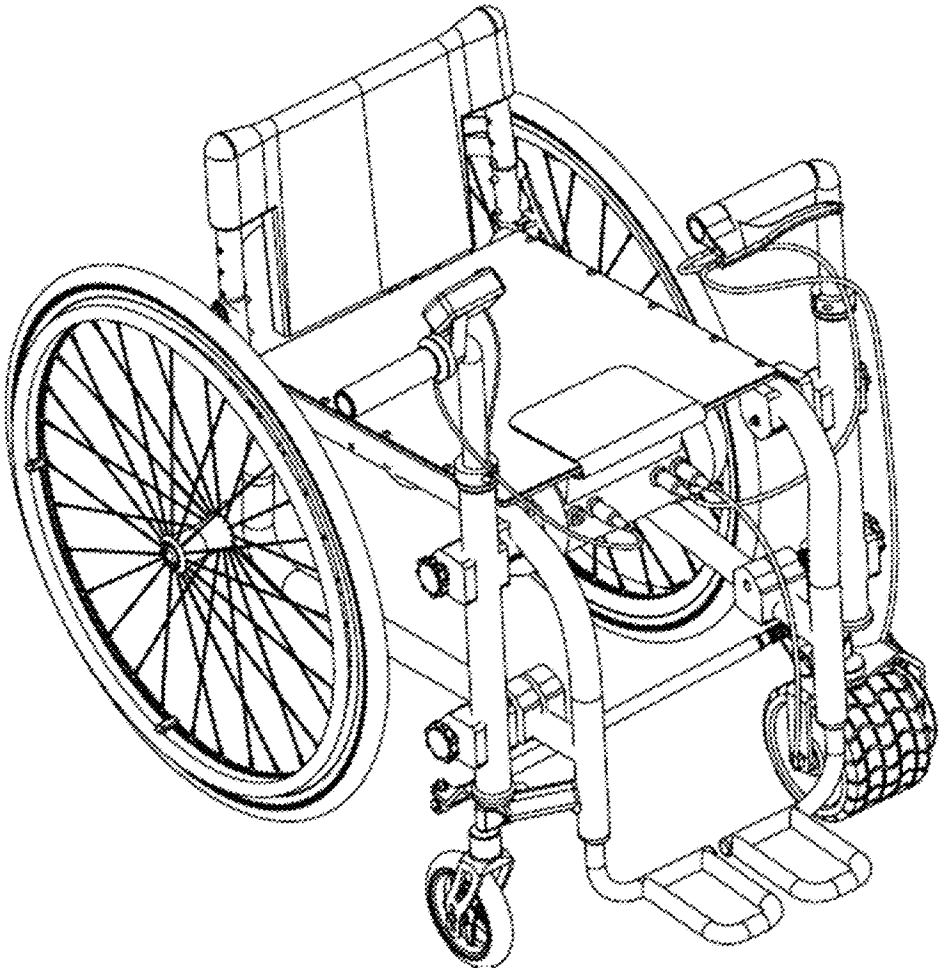
FIG. 6A is a perspective view of a wheelchair configured with an option with a steering column mounted on the driver's right and with a cross linked steering rod extending from said steering column to a support column mounted on the driver's left of the wheelchair where said support column terminates in a wheel driver hub.

FIG. 6A is a perspective view of the wheelchair 100 with a support column clamped to the left side of said wheelchair and ending in an electrical driver hub 25300. The steering column is clamped on the right side of the wheelchair and the bottom of said steering column is attached to the right caster wheel 150. The electrical and brake cables are also shown. The configuration shown in FIG. 6A also features a steering rod 214 (further identified in FIG. 6H) connecting the steering column to the driver hub assembly 25300. These features will be further explained and identified in subsequent figures. As previously stated, clamping the columns can be replaced by permanently affixing them to the wheelchair frames.

Figure 6B:
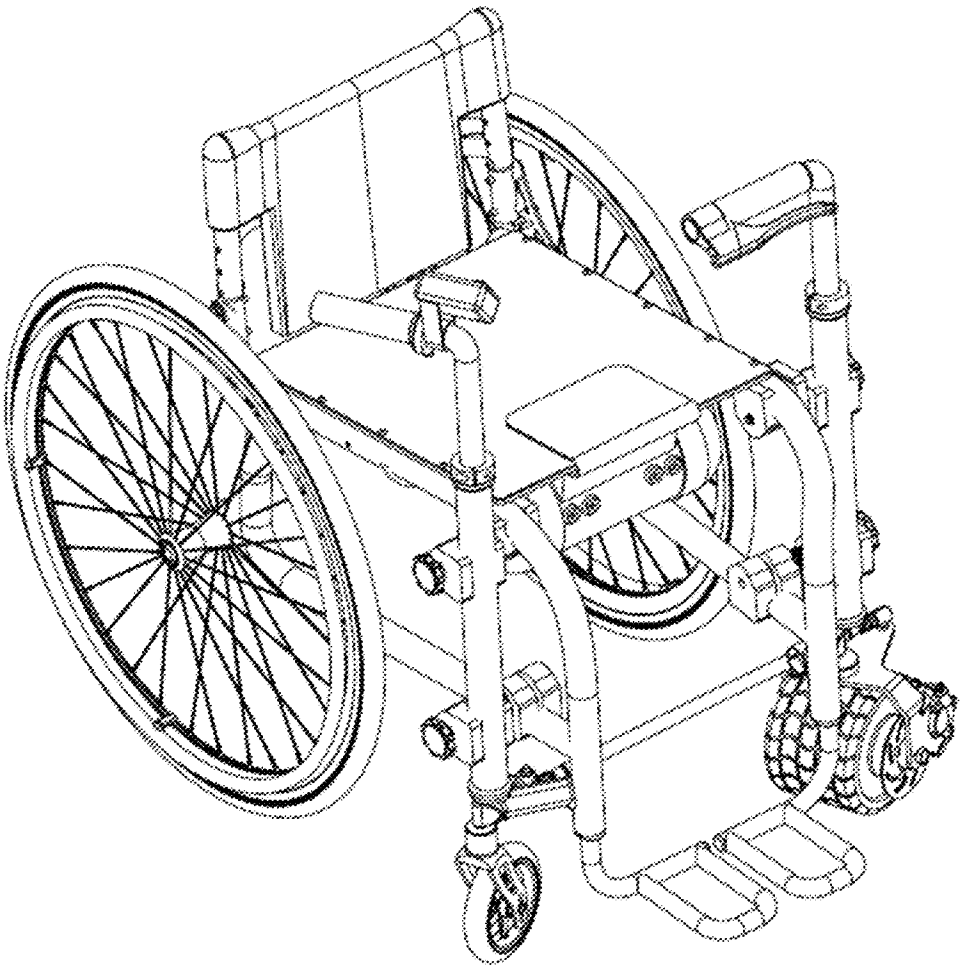
FIG. 6B shows a perspective view of the wheelchair shown in FIG. 6A where the right handlebar is rotated resulting in turning the driver hub to the right.

FIG. 6B is a perspective view of the wheelchair depicted in FIG. 6A without the electrical control cables but with the front caster wheel 150 turned to the right, the right handle bar rotated consistent with the turn of the wheels and the steering rod 214 controlling the matching turn of the driver hub assembly 25300.

Figure 6C:
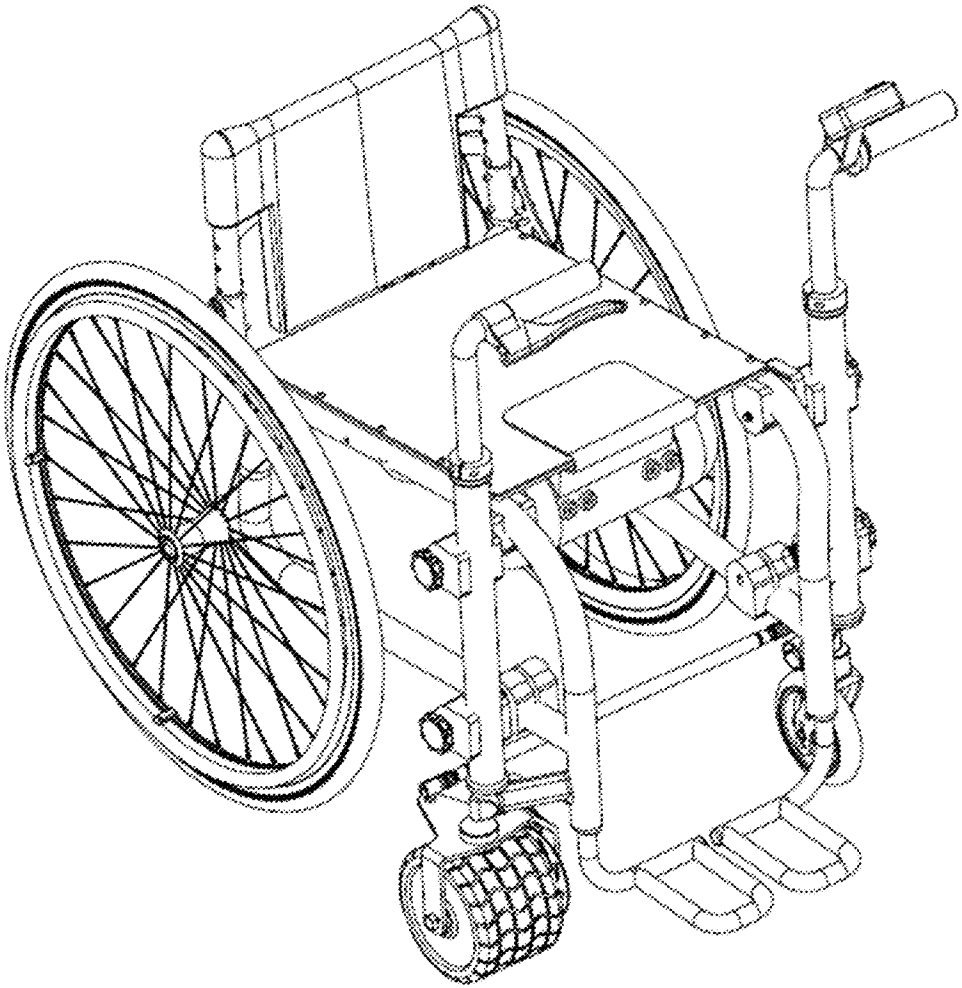
FIG. 6C is a perspective view of the wheelchair with the steering column mounted on the left and cross linked to the support column and driver hub mounted on the right.

FIG. 6C is a view of the wheelchair depicted in FIG. 6A but with the steering column and driver hub terminating column switched to opposite sides.

Figure 6D:
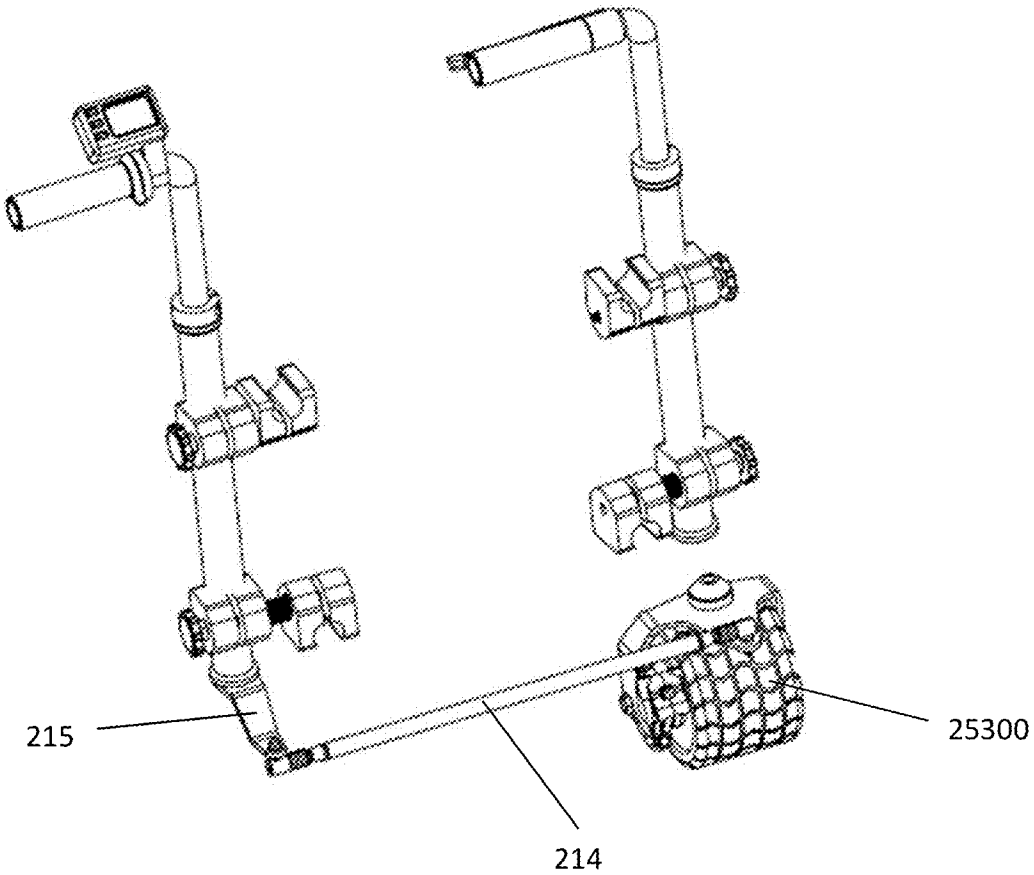
FIG. 6D is an isolated view of the steering and support columns shown in FIG. 6A as shown from the wheelchair occupant' perspective.

FIG. 6D is an isolated view of the first and second columns as depicted in FIG. 6A.

Figure 6E:
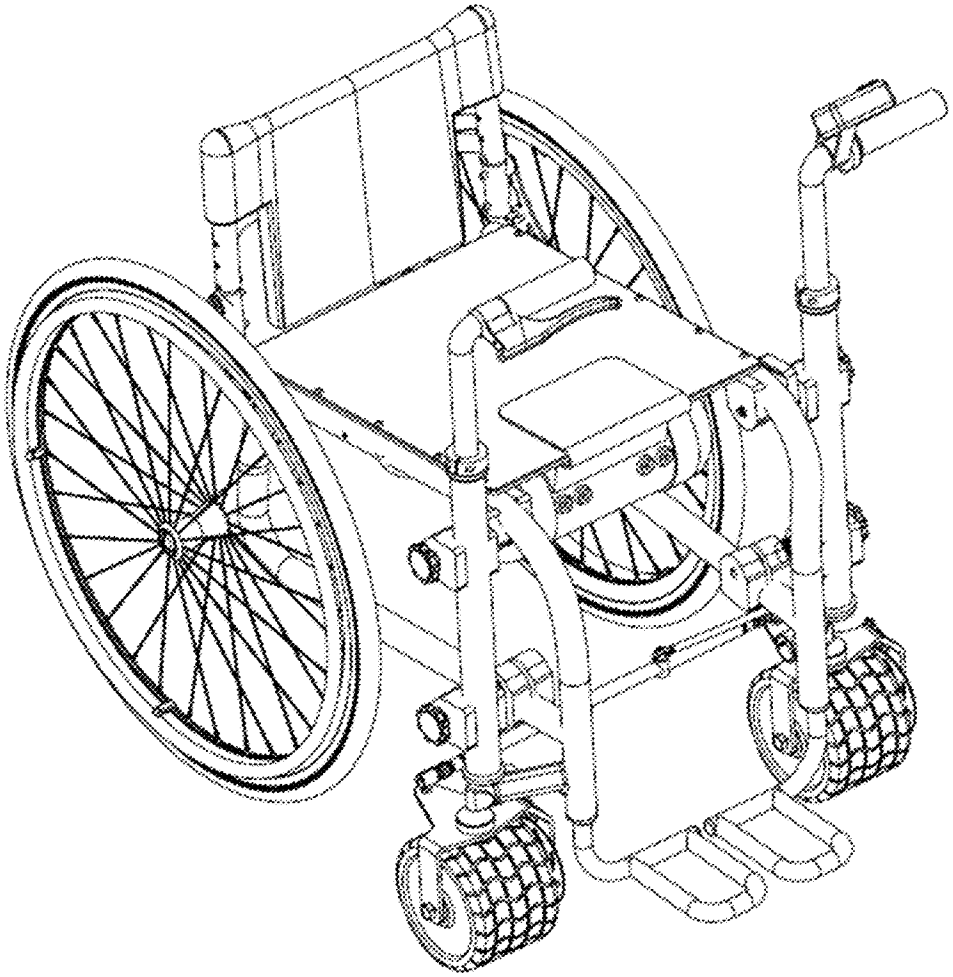
FIGS. 6E is a perspective view of the wheelchair with both steering column on the left and support column on the right both attached to driver hub assemblies with steering both driver hubs controlled by the cross link between the columns.

FIG. 6E is a perspective view of a wheelchair with electric driver hubs terminating both left and right columns. This configuration utilizes a variant of the cross-linked steering rods which will be further explained and detailed in subsequent drawings.

Figure 6F:
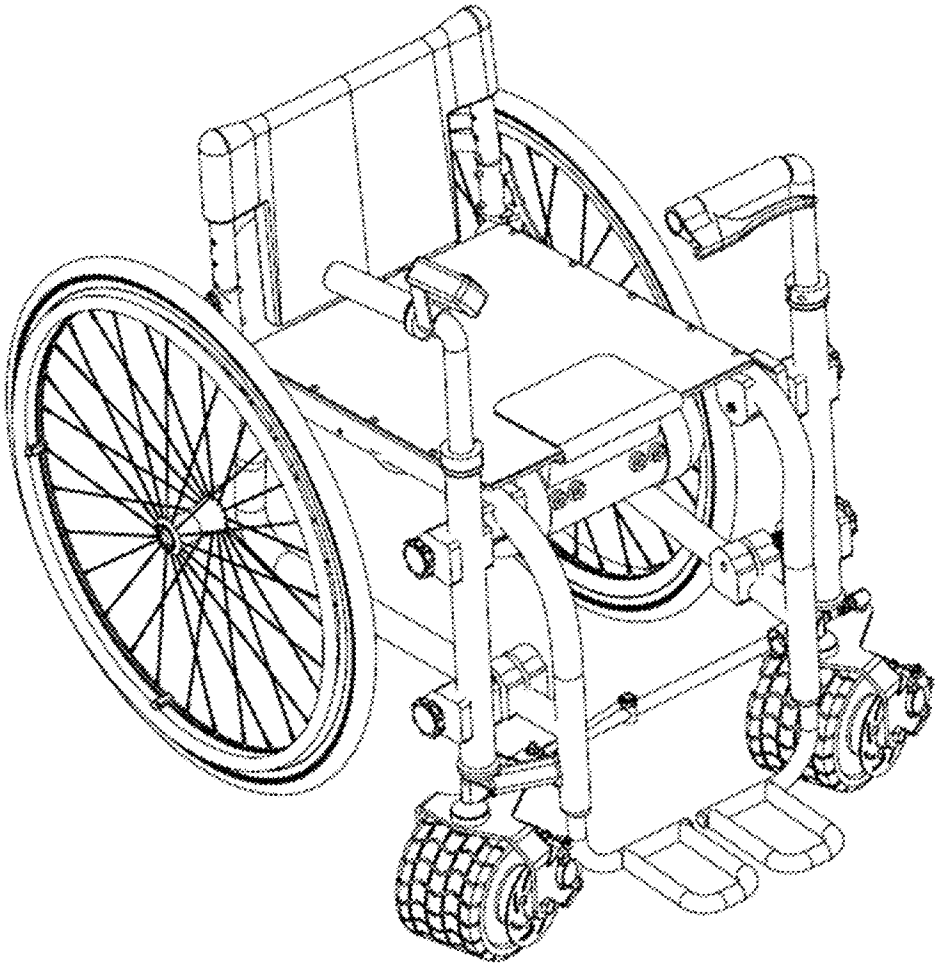
FIG. 6F is a perspective view of the wheelchair where the steering column on the right is rotated to turn both driver hubs to the right.

FIG. 6F is a perspective view of a wheelchair with dual electric driver hubs and with a variant of the cross linked steering rods which will be further explained and detailed in subsequent figures. In this depiction, the right steering column is rotated with concomitant turns of the left and right driver hub assemblies.

Figure 6G:
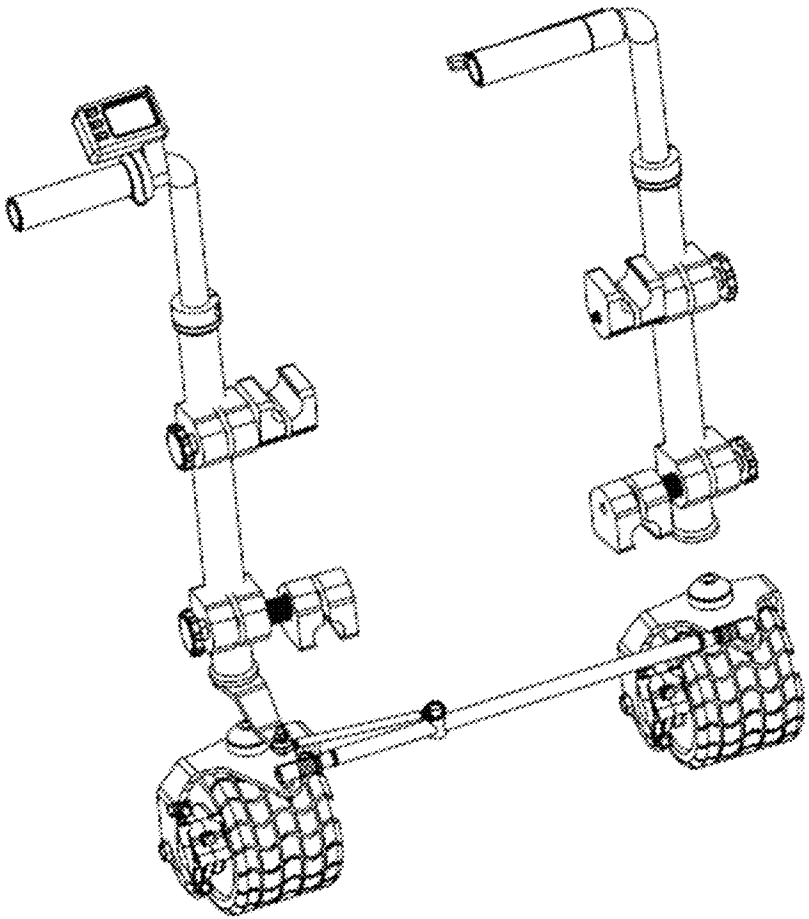
FIG. 6G is an isolated view of the steering and support columns. The columns may be interchanged as has been illustrated previously.
Figure 6I:
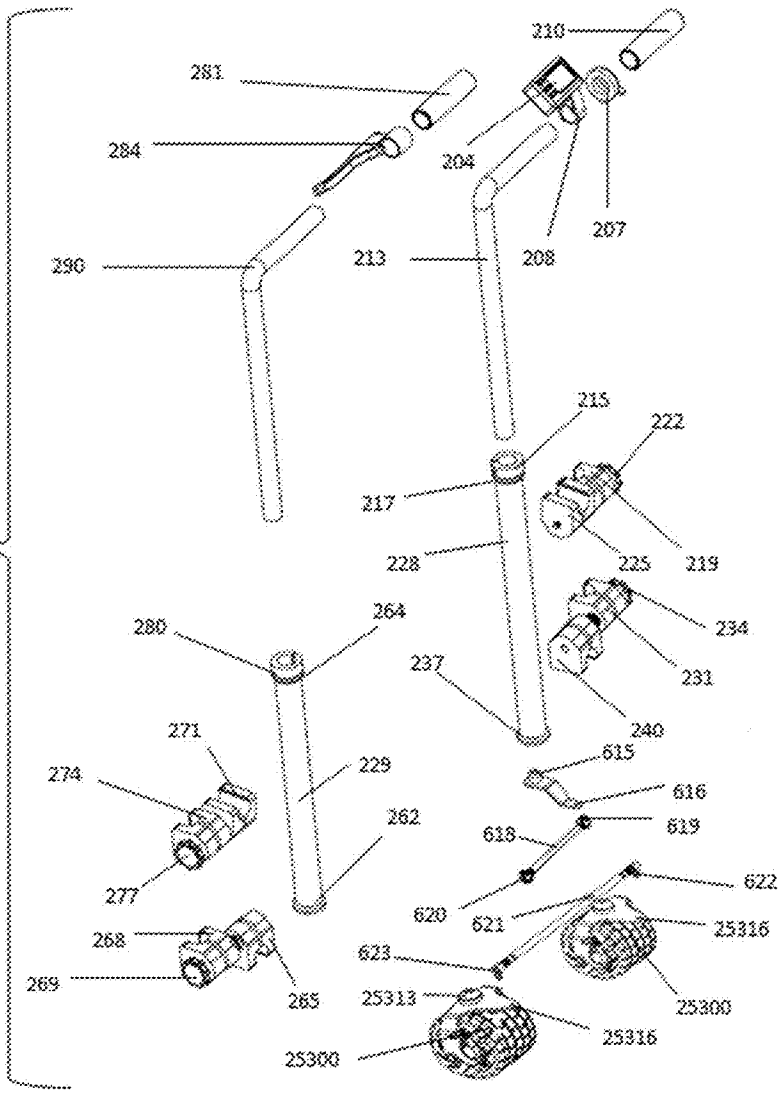
FIG. 6I is an exploded view of the steering and support columns both with driver hubs and the electrical and brake cables.

FIG. 6G is an isolated view of the left and right columns shown in FIG. 6E.

Figure 7A:
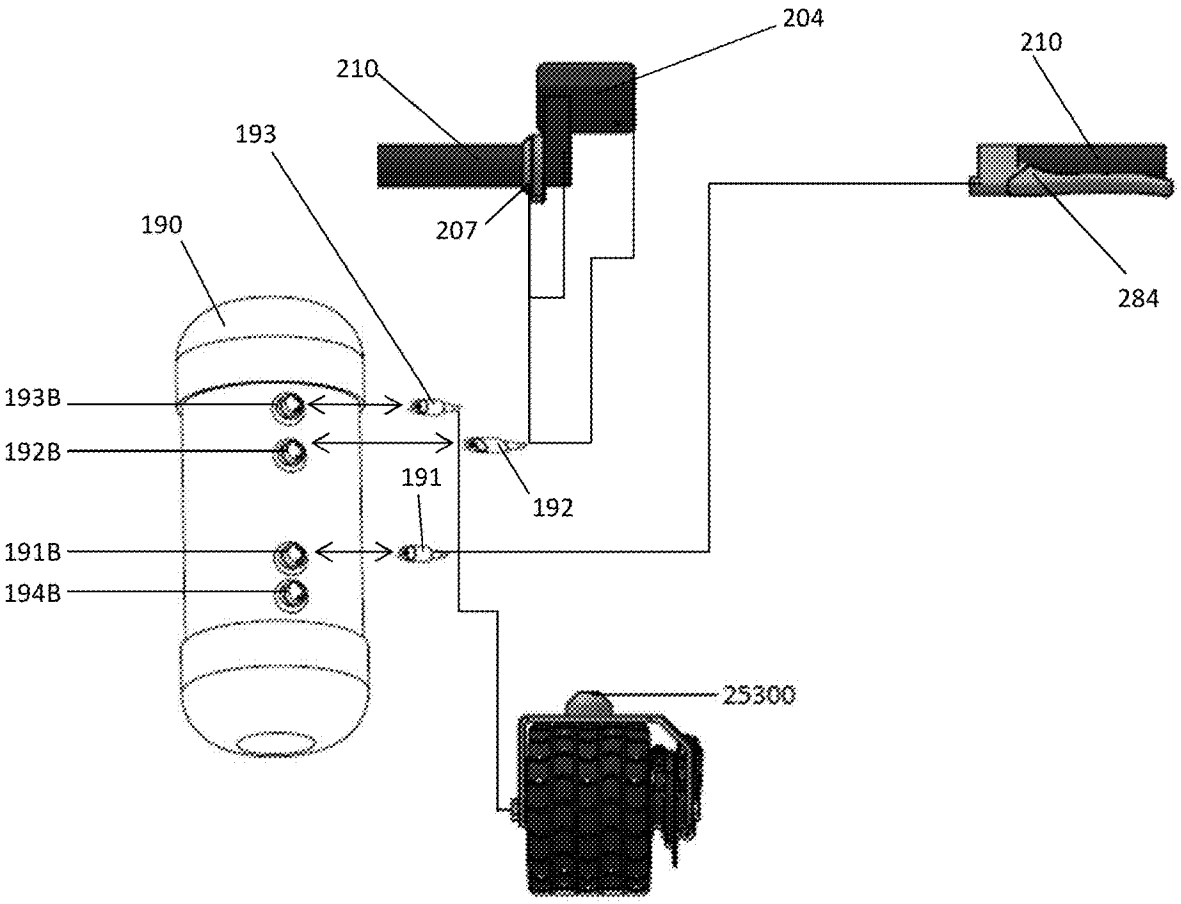
FIG. 7A is a diagram of the electrical circuitry required to power and control a single electric driver hub.

FIG. 6H is an exploded view of the steering and support columns configured as a variation of the configuration shown in FIG. 6A Here, the column terminating in the electric driver hub and with the LCD assembly and thumb throttle mounted on the handlebar is the support column. The other column, terminating in the caster wheel is the steering column. An isolated view of the same columns, but reversed on the wheelchair is shown in FIG. 6D. The construction of the support column with the brake handle 284 slipped on the handlebar portion of steering piece 290 is the same as has been previously described FIG. 7A is a diagram of the battery 190 driven electrical circuitry controlling the electric driver hub 25300, the LCD monitor 204, the forward/reverse switch 208, the thumb throttle 207 and braking controlled by the brake handle 284. Here, the battery insert 194B is not used since it is reserved for the electrical connection to a second electric driver hub. The electric driver hub 25300 or 25400 connects to the battery via cable and plug 193. The thumb throttle 207, the LCD monitor and the forward/reverse switch 208 connect to the battery insert 192B via cable and plug 192. The regenerative induction braking is energized via cable and plug 191 which connects to battery insert 191B.

Figure 7B:
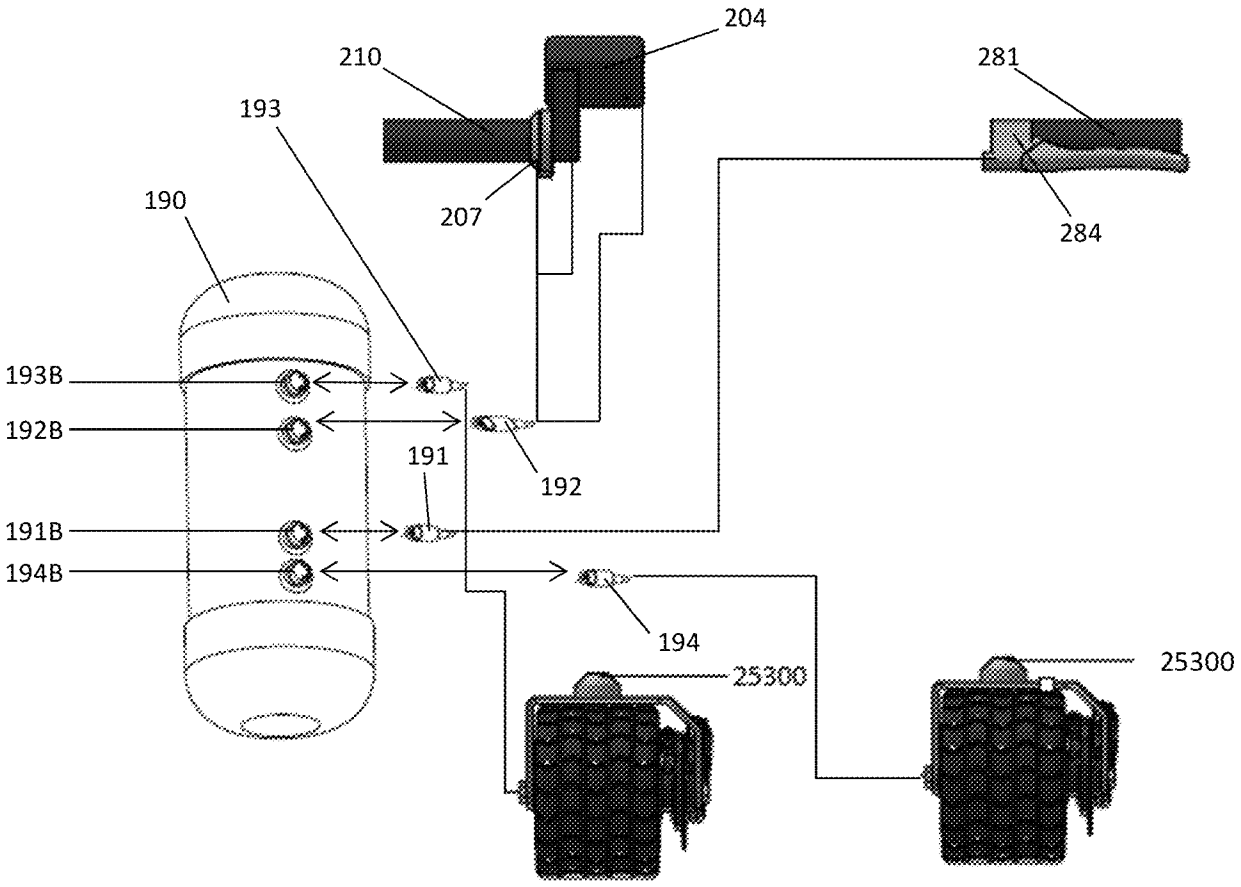
FIG. 7B is a diagram of the electrical circuitry required to power and control dual electric driver hubs.

FIG. 7B is a diagram of the electrical circuitry with two driver hubs. Here, the connections for cables 191, 192 and 193 are the same as described in FIG. 7A. The addition is that cable and plug 194 inserted into battery insert 194B which provides power for the second electric driver hub either 25300 or 25400.

Figure 8A:
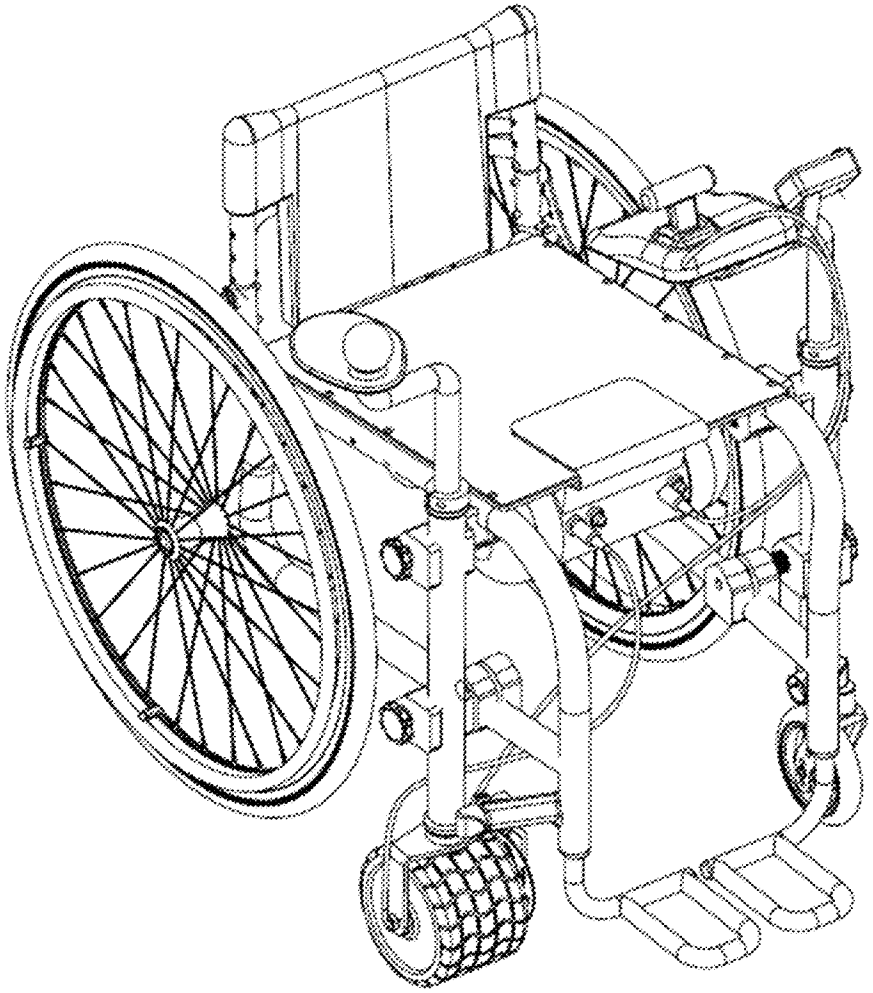
FIG. 8A is a perspective view a wheelchair equipped with alternative control means.

FIG. 8A is a perspective view of a wheelchair 100 equipped with alternative controls attached to the handlebar portions of control columns. The LCD assembly 204 with forward reverse switch 208 is mounted on the handlebar of steering piece 290. Additionally, a first resting pad 903 is similarly affixed to the handlebar portion of steering piece 290. An alternative forward/reverse switch 208B and a push/pull handle 904 providing control for forward motion (pushed forward) and braking (pulled backward are also mounted on resting pad 903.

Figure 8B:
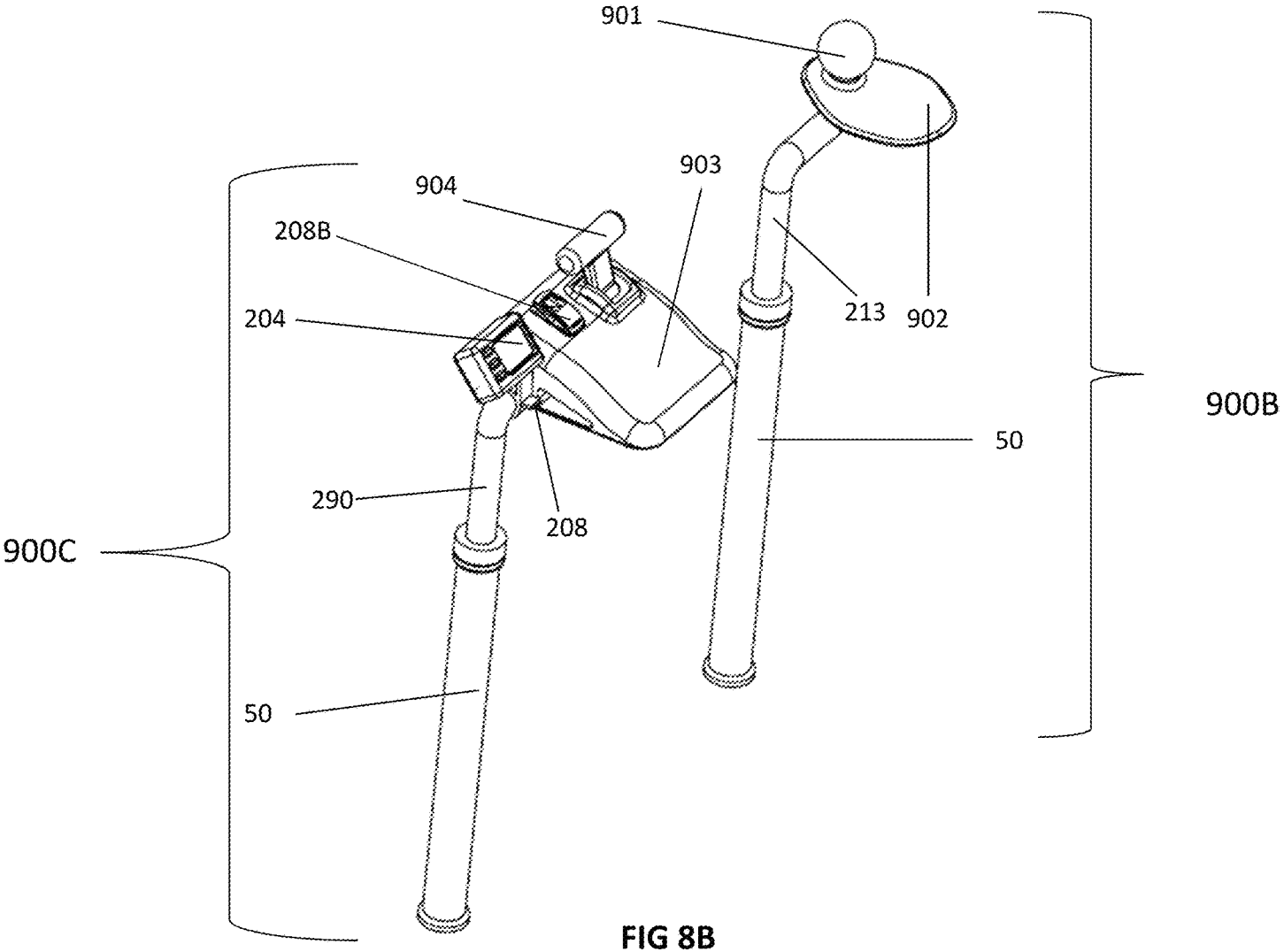
FIG. 8B is an isolated view detailing the controls shown in described in FIG. 8A with steering controlled by a twistable knob and forward and reverse motions controlled by a control handle wherein forward motion of said handle controls the degree of energy output to driver hubs and reverse motion of said handle controls braking.
Figure 8E:
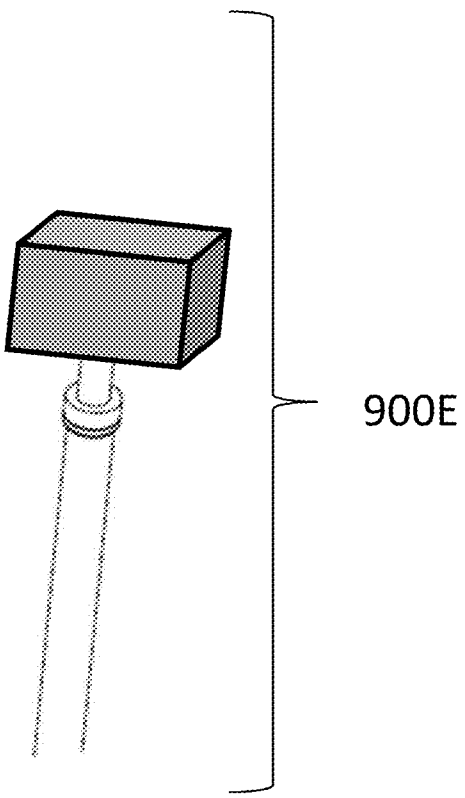
FIGS. 8C, 8D and 8E show isolated views of alternative control features later explained in the detailed description of the figures.

FIG. 8B second resting pad 902 is mounted on the handlebar portion of column piece 213. A steering knob 901 is mounted on resting pad 902. Steering is controlled by twisting said knob 901 to the left or right.

Figure 8D:
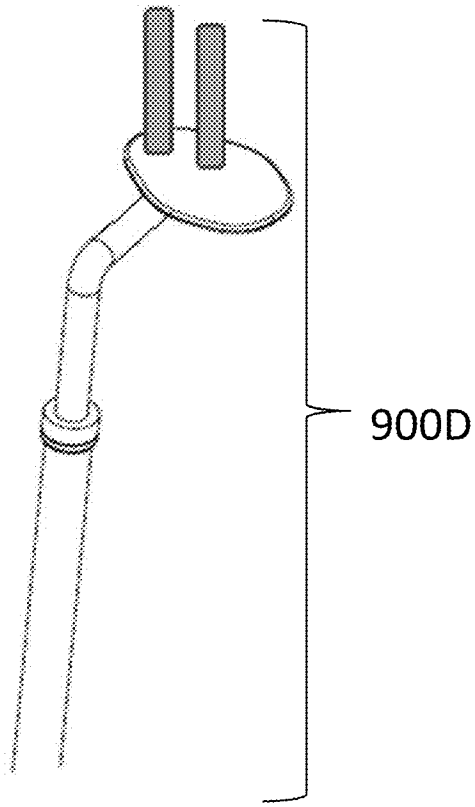
Figure 8C:
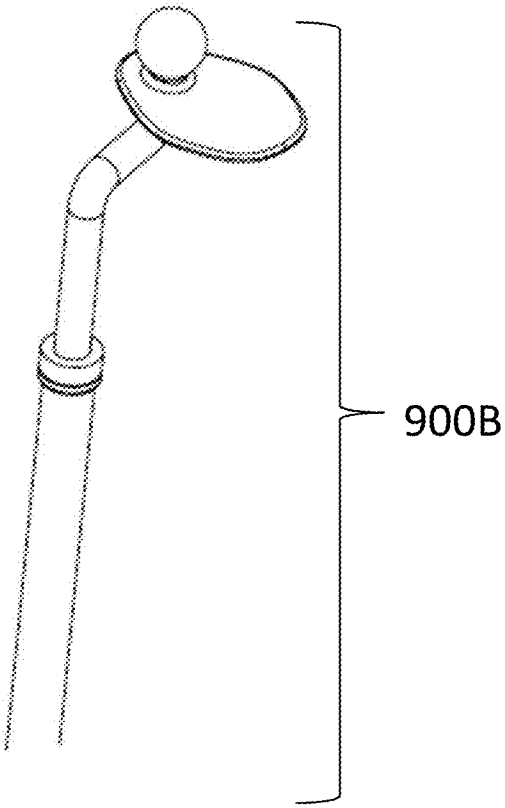
Figure 8F:
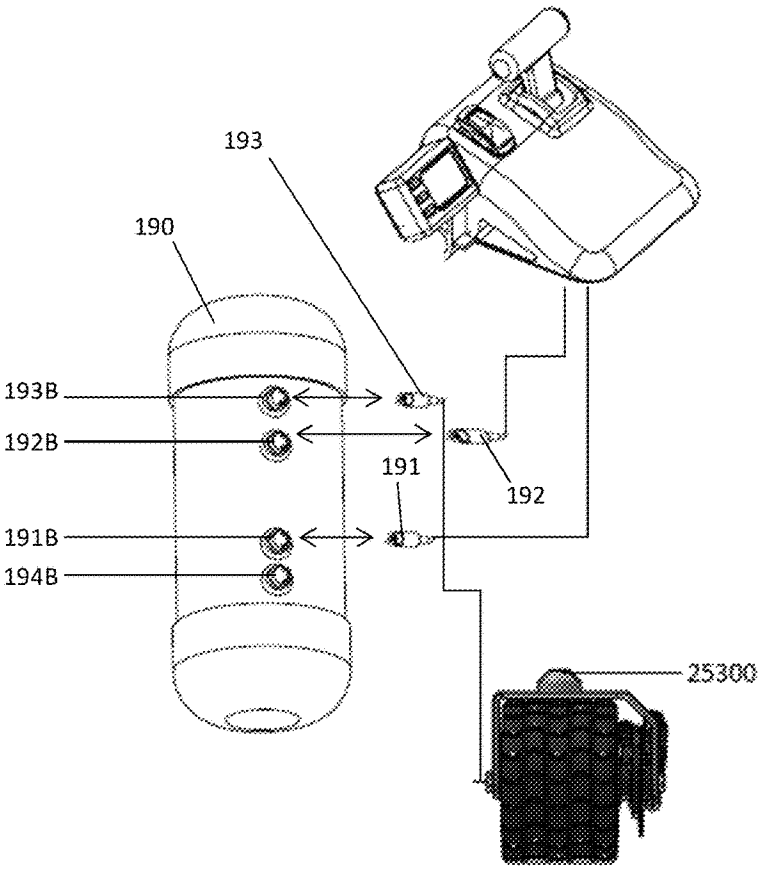
FIG. 8F is a schematic diagram of the circuitry used in controlling the apparatus with the push/pull handle shown in FIG. 8B to control apparatus with one driver hub.
Figure 8G:
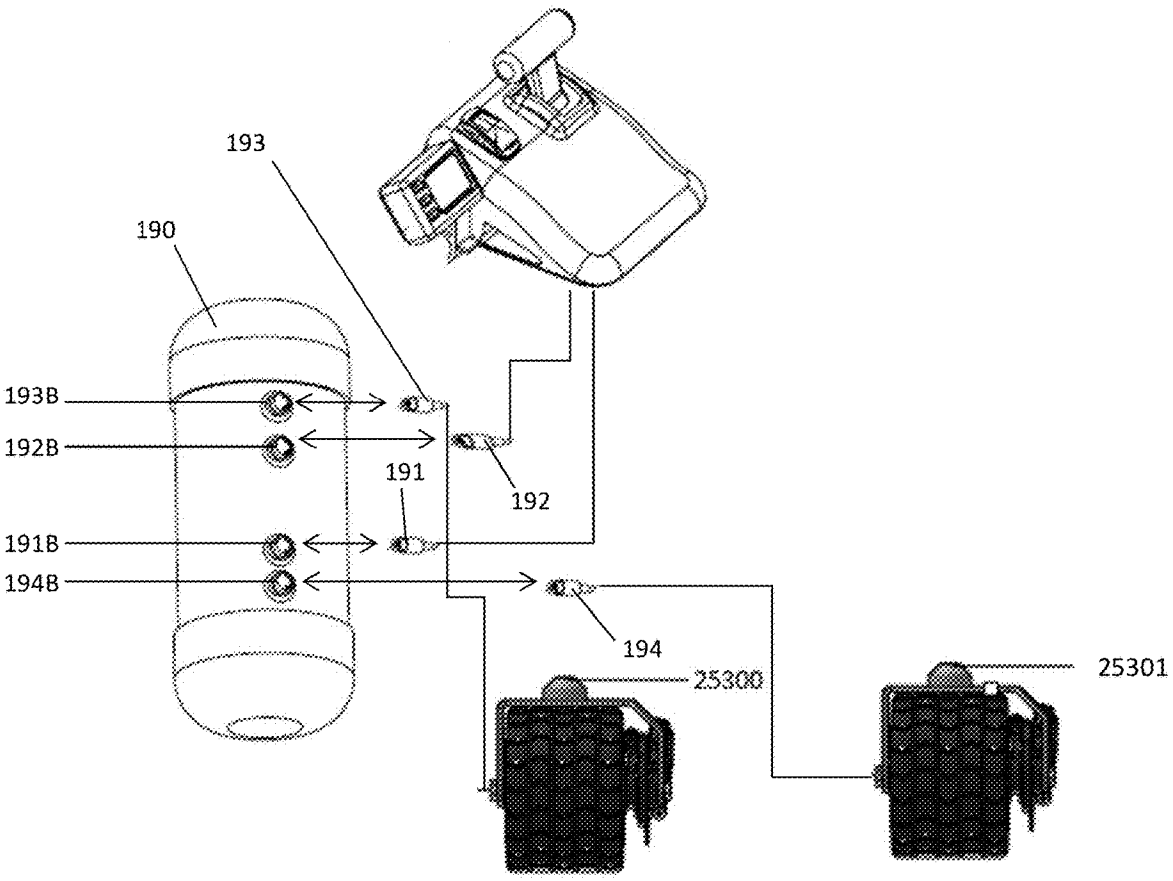
FIG. 8G is a schematic diagram of the circuitry used in controlling the apparatus with the push/pull handle shown in FIG. 8B to control apparatus with two driver hubs.

FIG. 8C shows an isolated column with the steering knob shown in FIG. 8B.

FIG. 8D shows an isolated view of a palm driven control device on said resting pad 902.

FIG. 8D shows an isolated column including a generic block representative of a group comprising additional control devices comprising a joystick, sip and puff device, chin control, head control, touch pad control, wafer board control, proximity switch control, single switch scanner control or computer mediated voice control.

What is claimed is:

1. A propulsion apparatus detachably mounted to a wheelchair comprising:

a steering column detachably mounted to a first horizontal frame member on a first lateral side of the wheelchair, wherein the steering column controls the turns of the wheelchair;

an electric drive hub assembly connected to the steering column, wherein the electric drive hub assembly comprises a wheel and a braking system;

a support column detachably mounted to a second horizontal frame member on a second lateral side of the wheelchair;

a caster wheel attached to a vertical frame member on the second lateral side of the wheelchair;

a battery assembly comprising a battery and a holder wherein the battery supplies power to the propulsion apparatus and the holder holds the battery assembly and is attached to the wheelchair; and a controller assembly connected to the battery assembly, wherein the controller assembly further comprises:

a monitor displaying the status of the wheelchair and the battery;

a switch controlling the rotation direction of the wheel of the electric drive hub assembly;

a thumb throttle controlling the speed of the wheel of the electric drive hub assembly;

a brake handle controlling the braking system of the electric drive hub assembly, wherein the brake handle is connected to the braking system; and a plurality of electrical cables connecting the battery assembly to the electric drive hub assembly and the controller assembly.

2. The propulsion apparatus of claim 1, wherein the steering column is detachably mounted to the first horizontal frame member on the first lateral side of the wheelchair and further comprising:

a first handlebar formed of right angle tubing with a shorter arm serving as a handle and a longer arm forming a portion of the steering column;

a ring clamp affixable to the longer arm;

a header tube detachably clamped to the first horizontal frame member on the first lateral side of the wheelchair and through which the longer arm of the first handlebar may be inserted and fixed in a vertical position using the ring clamp;

the electric drive hub assembly attached to a bottom end of the header tube; and a first and a second bearing, wherein the first bearing is attached at the top of the header tube and upon which the ring clamp attached to the longer arm may freely rotate, and wherein the second bearing is attached at the bottom end of the header tube and which facilitates free rotation of the electric drive hub assembly directed by the first handlebar.

3. The propulsion apparatus of claim 2, further comprises a second handlebar that connects to the support column in the same way as the first handlebar connects to the steering column.

4. The propulsion apparatus of claim 3, wherein the controller assembly is attached to the steering column, the support column, or the combination thereof.

5. The propulsion apparatus of claim 1, wherein the braking system is a mechanical braking system, a regenerative induction braking system or a combination thereof.

6. The propulsion apparatus of claim 1, wherein the electric drive hub assembly comprises an internal motor capable of forward and reverse speeds.

7. The propulsion apparatus of claim 1, wherein the electric drive hub assembly is a pulley driven by an external electric motor mounted on the steering column.

8. The propulsion apparatus of claim 1, further comprises a servo-mechanism to control the maneuver of the wheelchair, wherein the servo-mechanism is a steering knob, an integral joy-stick, a modular joy-stick, a wheelchair chin control, a wheelchair RIM (head) control, a finger wheelchair drive control, a touch pad wheelchair drive control, a wafer board wheelchair control, a proximity switch wheelchair control, a single switch scanner wheelchair control or a sip'n'puff wheelchair drive control.

9. The propulsion apparatus of claim 1, wherein the electric drive hub assembly and the caster wheel are steered using a linkage controlled by the steering column.

10. A propulsion apparatus detachably mounted to an unpowered wheelchair comprising:

a crossbar extending across the wheelchair and detachably clamped to a lower horizontal frame member on each lateral left and right side of the wheelchair;

a steering column to control a path of the wheelchair wherein the steering column comprises a central steering column detachably and pivotally mounted to the crossbar at the center of the wheelchair;

a first powered wheel system and a second powered wheel system, wherein the first and the second powered wheel systems are each connected to a vertical frame member on each left and right lateral side of the wheelchair and are further steered using a linkage controlled by the central steering column;

a power supply to supply power to the propulsion apparatus;

a braking system to control a speed of the first and the second powered wheel systems; and a controller enabling distribution of power from the power supply to the propulsion apparatus and attached to the central steering column further comprising;

an indicator displaying the status of the wheelchair and the power supply; and a throttle controlling the rotational direction and the speed of the first and the second powered wheel systems.

11. A propulsion apparatus detachably mounted to an unpowered wheelchair comprising:

a steering column mounted to a horizontal frame member on a first lateral side of the wheelchair, wherein the steering column controls the turns of the wheelchair;

a first powered wheel system attached to the bottom of the steering column;

a second powered wheel system attached to a vertical frame member on a second lateral side of the wheelchair wherein the first and the second powered wheel systems are steered using a linkage controlled by the steering column;

a power supply to supply power to the propulsion apparatus;

a braking system to control a speed of the first and the second powered wheel systems; and a controller enabling distribution of power from the power supply to the propulsion apparatus further comprising;

an indicator displaying the status of the wheelchair and the power supply; and a throttle controlling the rotational direction and the speed of the first and the second powered wheel systems.

* * * * *